US009387383B2

(12) United States Patent
Hou

(10) Patent No.: US 9,387,383 B2
(45) Date of Patent: Jul. 12, 2016

(54) BASEBALL BAT SWING TRAINING APPARATUS

(71) Applicant: Wen-Sun Hou, Westlake Village, CA (US)

(72) Inventor: Wen-Sun Hou, Westlake Village, CA (US)

(73) Assignee: BEST SWING ONE, LLC, Westlake Village, CA (US)

( * ) Notice: Subject to any disclaimer, the term of this patent is extended or adjusted under 35 U.S.C. 154(b) by 0 days.

(21) Appl. No.: 14/690,309

(22) Filed: Apr. 17, 2015

(65) Prior Publication Data

US 2015/0217173 A1 Aug. 6, 2015

Related U.S. Application Data

(63) Continuation-in-part of application No. 14/193,960, filed on Feb. 28, 2014, now Pat. No. 9,126,091, and a continuation-in-part of application No. 13/783,034, filed on Mar. 1, 2013, now Pat. No. 8,915,793.

(51) Int. Cl.
*A63B 69/00* (2006.01)
*A63B 49/08* (2015.01)
(Continued)

(52) U.S. Cl.
CPC ..... *A63B 69/0002* (2013.01); *A63B 15/00* (2013.01); *A63B 53/10* (2013.01); *A63B 60/16* (2015.10); *A63B 60/24* (2015.10); *A63B 69/3623* (2013.01); *A63B 69/3635* (2013.01); *A63B 69/38* (2013.01);
(Continued)

(58) Field of Classification Search
CPC ..... A63B 69/38; A63B 15/00; A63B 49/035; A63B 60/54; A63B 21/0088; A63B 21/0608; A63B 69/0002; A63B 59/50; A63B 69/3632; A63B 59/00; A63B 615/00; A63B 21/00043; A63B 21/045; A63B 49/02
USPC ..... 473/422, 457, 464, 451, 521, 538, 519, 473/564–568
See application file for complete search history.

(56) References Cited

U.S. PATENT DOCUMENTS 335,656 A * 2/1886 Taylor ..... A63B 49/08 473/526
537,927 A * 4/1895 Kennedy ..... A63B 60/54 473/520

(Continued)

OTHER PUBLICATIONS

Passaniti, S., U.S. Office Action, U.S. Appl. No. 13/783,034, Jul. 29, 2014, pp. 1-7.

(Continued)

*Primary Examiner* — Mitra Aryanpour
(74) *Attorney, Agent, or Firm* — Lyon & Harr, LLP; Richard T. Lyon

(57) ABSTRACT

A baseball bat swing training apparatus is provided that includes a bat and a slide mechanism. The bat includes handle and barrel sections that are spaced apart to form a gap therebetween. The mechanism is inserted within this gap and is connected to the upper end of the handle section and the lower end of the barrel section. The mechanism includes a sliding rail assembly and a rail guide that are cooperatively configured to insure that these upper and lower ends are substantially coaxial when the sliding rail assembly is situated in a rightmost position on the rail guide, and permit a lateral shift of this lower end relative to this upper end during a swinging of the bat. A tennis racket swing training apparatus is also provided where the mechanism is inserted within a gap that is formed between upper and lower portions of the racket's handle section.

28 Claims, 17 Drawing Sheets

(51) Int. Cl.

| | |
|---|---|
| ***A63B 69/38*** | (2006.01) |
| ***A63B 69/36*** | (2006.01) |
| ***A63B 15/00*** | (2006.01) |
| ***A63B 53/10*** | (2015.01) |
| *A63B 71/06* | (2006.01) |

(52) U.S. Cl.

CPC *A63B 2060/0081* (2015.10); *A63B 2069/0008* (2013.01); *A63B 2071/0602* (2013.01); *A63B 2071/0625* (2013.01); *A63B 2071/0655* (2013.01); *A63B 2208/0204* (2013.01); *Y10T 29/49817* (2015.01)

(56) References Cited

U.S. PATENT DOCUMENTS

| | | | | | |
|---|---|---|---|---|---|
| 546,540 | A | * | 9/1895 | Kennedy | A63B 60/54 473/520 |
| 695,579 | A | | 3/1902 | Parmele | |
| 1,428,015 | A | | 9/1922 | Dienner | |
| 1,509,733 | A | * | 9/1924 | Langford | A63B 60/54 473/520 |
| 1,529,305 | A | | 3/1925 | Gatke | |
| 2,158,211 | A | * | 5/1939 | Aitken | A63B 69/3632 473/220 |
| 2,159,579 | A | * | 5/1939 | Whitney | A63B 69/3632 473/232 |
| 2,772,887 | A | * | 12/1956 | Blake | A63B 69/0002 473/457 |
| 3,180,308 | A | | 4/1965 | Carroli et al. | |
| 3,341,203 | A | | 9/1967 | Brill | |
| 3,414,260 | A | * | 12/1968 | Gust | A63B 15/00 473/457 |
| 3,428,325 | A | * | 2/1969 | Atkinson | A63B 15/00 473/457 |
| 3,679,205 | A | * | 7/1972 | Finkle | A63B 69/38 473/463 |
| 3,953,035 | A | | 4/1976 | Beckisk | |
| 4,027,886 | A | | 6/1977 | Katsube | |
| 4,145,054 | A | | 3/1979 | Stewart | |
| 4,249,729 | A | * | 2/1981 | Gabrielidis | A63B 21/00043 473/464 |
| 4,367,871 | A | * | 1/1983 | Schiefer | A63B 49/035 473/463 |
| 4,399,996 | A | * | 8/1983 | Boyce | A63B 69/0002 473/457 |
| 4,555,111 | A | * | 11/1985 | Alvarez | A63B 69/0002 473/457 |
| 4,576,378 | A | | 3/1986 | Backus | |
| 4,614,343 | A | | 9/1986 | Radway | |
| 4,746,119 | A | * | 5/1988 | Jeanrot | A63B 49/038 473/531 |
| 4,854,585 | A | | 8/1989 | Koch et al. | |
| 4,932,661 | A | | 6/1990 | Choi | |
| 4,969,921 | A | | 11/1990 | Silvera | |
| 5,026,064 | A | | 6/1991 | Novosel | |
| 5,037,103 | A | | 8/1991 | Williams et al. | |
| 5,082,283 | A | | 1/1992 | Conley et al. | |
| 5,143,373 | A | * | 9/1992 | Meissner | A63B 49/02 473/463 |
| 5,143,376 | A | | 9/1992 | Johnson | |
| 5,195,748 | A | | 3/1993 | Koch | |
| 5,226,652 | A | | 7/1993 | Sato | |
| 5,277,427 | A | | 1/1994 | Bryan et al. | |
| 5,372,557 | A | | 12/1994 | Ostigny | |
| 5,415,406 | A | | 5/1995 | Reichenbach et al. | |
| 5,467,993 | A | | 11/1995 | Higginson | |
| 5,516,097 | A | * | 5/1996 | Huddleston | A63B 59/50 473/457 |
| 5,527,039 | A | | 6/1996 | Levesque | |
| 5,580,321 | A | | 12/1996 | Rennhack | |
| 5,588,920 | A | | 12/1996 | Soong | |
| 5,616,087 | A | | 4/1997 | Bothwell | |
| 5,700,205 | A | | 12/1997 | Sanford | |
| 5,735,752 | A | | 4/1998 | Antonious | |
| 5,860,871 | A | | 1/1999 | Marley, Jr. | |
| 5,941,779 | A | | 8/1999 | Zeiner-Gundersen | |
| 6,012,988 | A | | 1/2000 | Burke | |
| 6,059,668 | A | | 5/2000 | Marley, Jr. | |
| 6,071,199 | A | | 6/2000 | Suzuki | |
| 6,241,629 | B1 | * | 6/2001 | Otto | A63B 69/0002 473/457 |
| 6,257,992 | B1 | | 7/2001 | LeBlanc | |
| 6,358,157 | B1 | | 3/2002 | Sorenson | |
| 6,440,005 | B1 | | 8/2002 | Hubenig | |
| 6,569,042 | B2 | * | 5/2003 | LaChance | A63B 15/00 473/457 |
| 6,625,848 | B1 | * | 9/2003 | Schneider | A01B 1/02 473/520 |
| 6,881,156 | B1 | | 4/2005 | Philips | |
| 7,018,302 | B2 | | 3/2006 | Jacoby | |
| 7,041,000 | B1 | | 5/2006 | Galloway | |
| 7,074,133 | B1 | | 7/2006 | Jones et al. | |
| 7,235,024 | B2 | * | 6/2007 | Lefebvre | A63B 15/00 473/457 |
| 7,285,055 | B2 | | 10/2007 | Radle | |
| 7,297,077 | B1 | * | 11/2007 | Battaglino | A63B 59/00 473/422 |
| 7,416,492 | B2 | | 8/2008 | Wesley | |
| 7,455,595 | B1 | | 11/2008 | Gibbons et al. | |
| 8,348,779 | B2 | | 1/2013 | Kim | |
| 8,491,423 | B1 | * | 7/2013 | Biggio | A63B 59/50 473/422 |
| 2004/0162167 | A1 | * | 8/2004 | Stevens | A63B 21/0088 473/457 |
| 2006/0122000 | A1 | | 6/2006 | Paredes et al. | |
| 2007/0275788 | A1 | | 11/2007 | Delpine | |
| 2010/0167830 | A1 | | 7/2010 | Hinton et al. | |
| 2012/0064986 | A1 | | 3/2012 | Brooks | |
| 2013/0267340 | A1 | | 10/2013 | Wolf | |

OTHER PUBLICATIONS

Passaniti, S., U.S. Notice of Allowance, U.S. Appl. No. 13/783,034, Oct. 29, 2014, pp. 1-8.

Passaniti, S., U.S. Office Action, U.S. Appl. No. 14/193,960, Mar. 26, 2015, pp. 1-9.

Passaniti, S., U.S. Notice of Allowance, U.S. Appl. No. 14/193,960, Jun. 10, 2015, pp. 1-7.

* cited by examiner

BASEBALL BAT SWING TRAINING APPARATUS

CROSS REFERENCE TO RELATED APPLICATIONS

This application is a continuation-in-part of U.S. application Ser. No. 14/193,960 which was filed Feb. 28, 2014, which is a continuation-in-part of U.S. application Ser. No. 13/783,034 which was filed Mar. 1, 2013 and subsequently issued as U.S. Pat. No. 8,915,793. The disclosure of application Ser. Nos. 14/193,960 and 13/783,034 is hereby incorporated by reference.

BACKGROUND

As is appreciated in the sport of baseball, a baseball player who is batting at home plate against a pitcher is known as a batter who is at bat. A big part of the offensive success of a baseball team stems from each batter's ability to swing a baseball bat and hit a baseball that is thrown to them by the pitcher. There are many different factors that affect a batter's ability to hit a baseball that is thrown to them. While some of these factors can be controlled by the batter (e.g., where the batter stands in relation to home plate, and the mechanics of how the batter swings their bat), many others of these factors are completely out of the batter's control (e.g., the current lighting and weather conditions, the skill level of the pitcher, and the types of pitches that the pitcher throws to the batter). As such, it is often said that hitting a baseball while being at bat is one of the hardest things to do in sports.

Baseball players must possess a strong mastery of a combination of many diverse skills to be able to frequently hit a baseball that is thrown to them while they are at bat. While a very small number of baseball players are gifted with the talent/skills to frequently hit a baseball that is thrown to them while they are at bat, the vast majority of baseball players have to work on their batting/hitting skills. Baseball players continuously strive to improve the mechanics of how they swing their baseball bat (e.g., perfect their swing), with a goal of becoming a better hitter (e.g., increasing the speed of their swing and frequency of getting a hit while they are at bat). Various types of training aids exist that are intended to help baseball players become a better hitter.

SUMMARY

Training apparatus embodiments described herein generally involve a swing training apparatus. In one exemplary embodiment a baseball bat swing training apparatus includes a baseball bat and a slide mechanism. The bat includes two separate and distinct sections that are spaced apart to form a gap there-between, where these sections include a handle section and a barrel section. The slide mechanism is inserted within this gap and is connected to the upper end of the handle section and the lower end of the barrel section. The slide mechanism includes a sliding rail assembly and a rail guide that are cooperatively configured to insure that this upper end and this lower end are substantially coaxial when the sliding rail assembly is situated in a rightmost position on the rail guide, and permit a lateral shift of this lower end relative to this upper end during a swinging of the bat.

In another exemplary embodiment a tennis racket swing training apparatus includes a tennis racket and a slide mechanism. The racket includes a handle section, a head section, and a throat section that rigidly interconnects the handle and head sections. The handle section includes two separate and distinct portions that are spaced apart to form a gap there-between, where these portions include an upper portion and a lower portion. The slide mechanism is inserted within this gap and is connected to the upper end of the lower portion of the handle section and the lower end of the upper portion of the handle section. The slide mechanism includes a sliding rail assembly and a rail guide that are cooperatively configured to insure that this upper end and this lower end are substantially coaxial when the sliding rail assembly is situated in a rightmost position on the rail guide, and permit a lateral shift of this lower end relative to this upper end during a swinging of the racket.

It should be noted that the foregoing Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter. Its sole purpose is to present some concepts of the claimed subject matter in a simplified form as a prelude to the more detailed description that is presented below.

DESCRIPTION OF THE DRAWINGS

The specific features, aspects, and advantages of the training apparatus embodiments described herein will become better understood with regard to the following description, appended claims, and accompanying drawings where:

FIG. 9 illustrates a standalone transparent plan view, in simplified form, of an exemplary embodiment of the sliding rail member taken from the perspective of FIG. 6.

FIG. 13 illustrates a standalone transparent plan view, in simplified form, of an exemplary embodiment of the rail guide taken from the perspective of FIG. 6.

DETAILED DESCRIPTION

In the following description of training apparatus embodiments reference is made to the accompanying drawings which form a part hereof, and in which are shown, by way of illustration, specific embodiments in which the training apparatus can be practiced. It is understood that other embodiments can be utilized and structural changes can be made without departing from the scope of the training apparatus embodiments.

It is also noted that for the sake of clarity specific terminology will be resorted to in describing the training apparatus embodiments described herein and it is not intended for these embodiments to be limited to the specific terms so chosen. Furthermore, it is to be understood that each specific term includes all its technical equivalents that operate in a broadly similar manner to achieve a similar purpose. Reference herein to "one embodiment", or "another embodiment", or an "exemplary embodiment", or an "alternate embodiment", or "one implementation", or "another implementation", or an "exemplary implementation", or an "alternate implementation" means that a particular feature, a particular structure, or particular characteristics described in connection with the embodiment or implementation can be included in at least one embodiment of the training apparatus. The appearances of the phrases "in one embodiment", "in another embodiment", "in an exemplary embodiment", "in an alternate embodiment", "in one implementation", "in another implementation", "in an exemplary implementation", and "in an alternate implementation" in various places in the specification are not necessarily all referring to the same embodiment or implementation, nor are separate or alternative embodiments/implementations mutually exclusive of other embodiments/implementations. Yet furthermore, the order of process flow representing one or more embodiments or implementations of the training apparatus does not inherently indicate any particular order nor imply any limitations of the training apparatus.

Yet, furthermore, to the extent that the terms "includes," "including," "has," "contains," variants thereof, and other similar words are used in either this detailed description or the claims, these terms are intended to be inclusive, in a manner similar to the term "comprising", as an open transition word without precluding any additional or other elements.

1.0 Baseball Bats Overview

Figure 1:
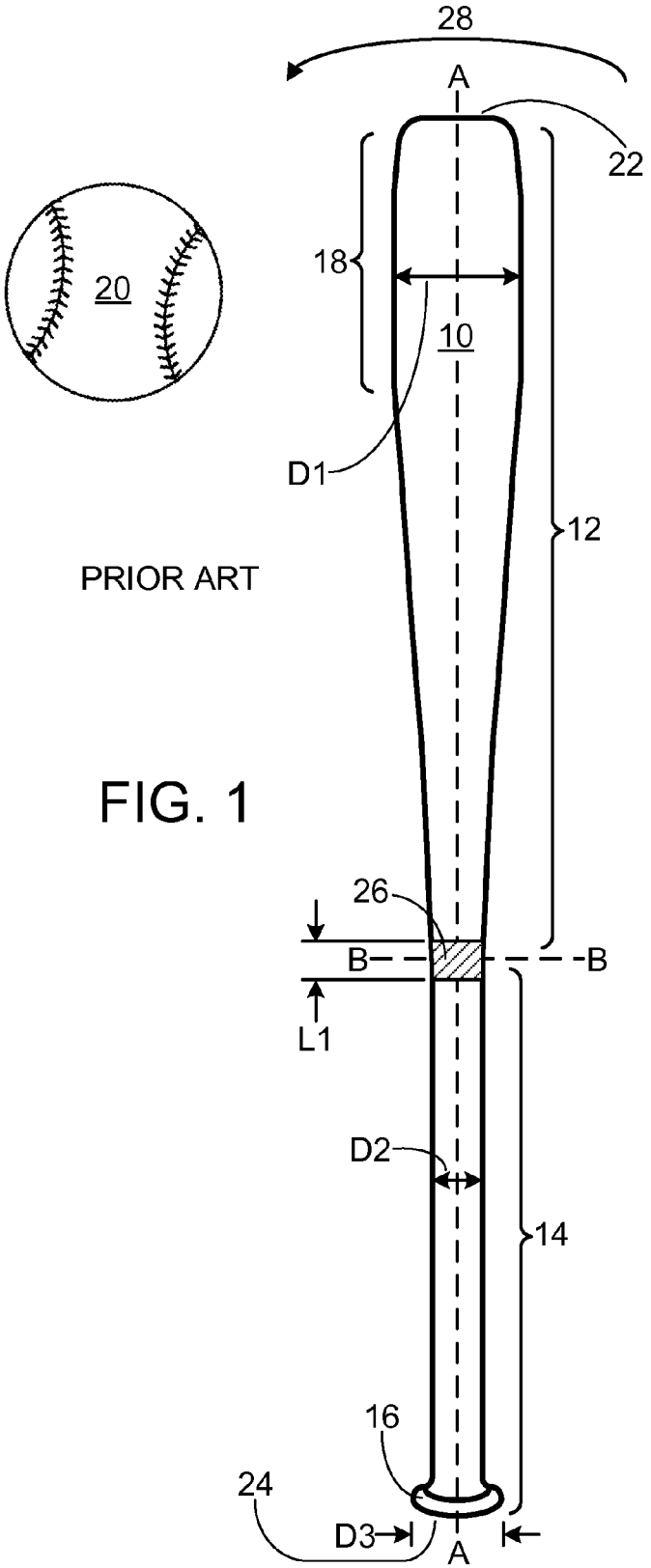
FIG. 1 is a diagram illustrating a plan view, in simplified form, of an exemplary embodiment of a conventional baseball bat and a conventional baseball.

FIG. 1 illustrates a plan view, in simplified form, of an exemplary embodiment of a conventional baseball bat (herein sometimes simply referred to as a bat) that is swung by a batter in an attempt to hit a conventional baseball (herein sometimes simply referred to as a ball) that is thrown by a pitcher. As exemplified in FIG. 1, the baseball bat 10 has an elongated, smooth, cylindrical shape whose diameter varies along the longitudinal axis A-A of the bat, where this shape is specifically designed to allow the batter to swing the bat in a quick and balanced manner and transfer as much energy as possible to the baseball 20 when it is hit by the bat. The bat 10 generally includes two different longitudinal sections, namely a handle section 14 the lower end of which forms the proximal end 24 of the bat, and a barrel section 12 the upper end of which forms the distal end 22 of the bat. A substantial majority (e.g., most) of the handle section 14 of the bat 10 has a longitudinally constant or varying diameter D2 that is selected to allow the batter to comfortably grip the bat with both of their hands. The barrel section 12 of the bat 10 is meant to hit the ball 20 and thus has a range of diameters that is greater than or equal to the diameter D2 and less than or equal to a prescribed maximum diameter D1 that is substantially larger than D2. The portion 18 of the barrel section 12 having the maximum diameter D1 is often referred to as the "sweet spot" of the bat 10 since it has the largest surface area and mass per unit of measure along the longitudinal axis A-A. The sweet spot 18 of the bat 10 is thus ideally suited to hitting the ball 20.

Referring again to FIG. 1, the diameter of the barrel section 12 of the bat 10 gradually decreases from D1 to D2 as the barrel section longitudinally approaches the handle section 14 of the bat 10. The bottommost portion of the handle section 14 includes a knob 16 having a diameter D3 that is larger than diameter D2 and smaller than diameter D1. The knob 16 serves the function of preventing the bat 10 from slipping out of the batter's hands when they forcibly swing the bat.

As is also appreciated in the sport of baseball and referring again to FIG. 1, there are various types of conventional baseball bats 10 which can be generally categorized as follows. A wood bat is a type of bat 10 in which both the barrel and handle sections 12 and 14 of the bat are made of a prescribed type of wood (such as maple, or ash, or birch, or hickory, or bamboo, among other types of wood). A metal bat is another type of bat 10 in which both of the barrel and handle sections 12 and 14 of the bat are made of either a prescribed type of light-weight metal (e.g., aluminum, among other types of metal) or a prescribed light-weight metal alloy (e.g., aluminum mixed with one or more other types of metal). A composite bat is yet another type of bat 10 in which both the barrel and handle sections 12 and 14 of the bat are made of a prescribed composite material (e.g., a mixture of carbon fiber, graphite, fiberglass, and sometimes Kevlar, bonded together using a prescribed resin). A hybrid bat is yet another type of bat 10 in which the barrel section 12 of the bat is made of one type of material (e.g., either a prescribed type of metal or a prescribed metal alloy) and the handle section 14 of the bat is made from another type of material (e.g., a prescribed composite material). As will be appreciated from the more detailed description that follows, the training apparatus embodiments described herein are can be used with any type of baseball bat including, but not limited to, a conventional wood bat, or a conventional metal bat, or a conventional composite bat, or a conventional hybrid bat, among other types of bats.

2.0 Baseball Bat Swing Training Apparatus

The training apparatus embodiments described in this section generally relate to the field of baseball bats and more particularly to a baseball bat swing training apparatus that batters can use to improve the mechanics of how they swing their bat (e.g., perfect their swing) and thus become better hitters (e.g., increase the speed of their swing and frequency of getting a hit while they are at bat). In other words and as will be appreciated from the more detailed description that follows, the training apparatus embodiments teach a batter to swing their bat faster (e.g., increase their bat speed and power), thus enabling the batter to hit a baseball that is thrown to them harder and further more consistently.

Figure 4:
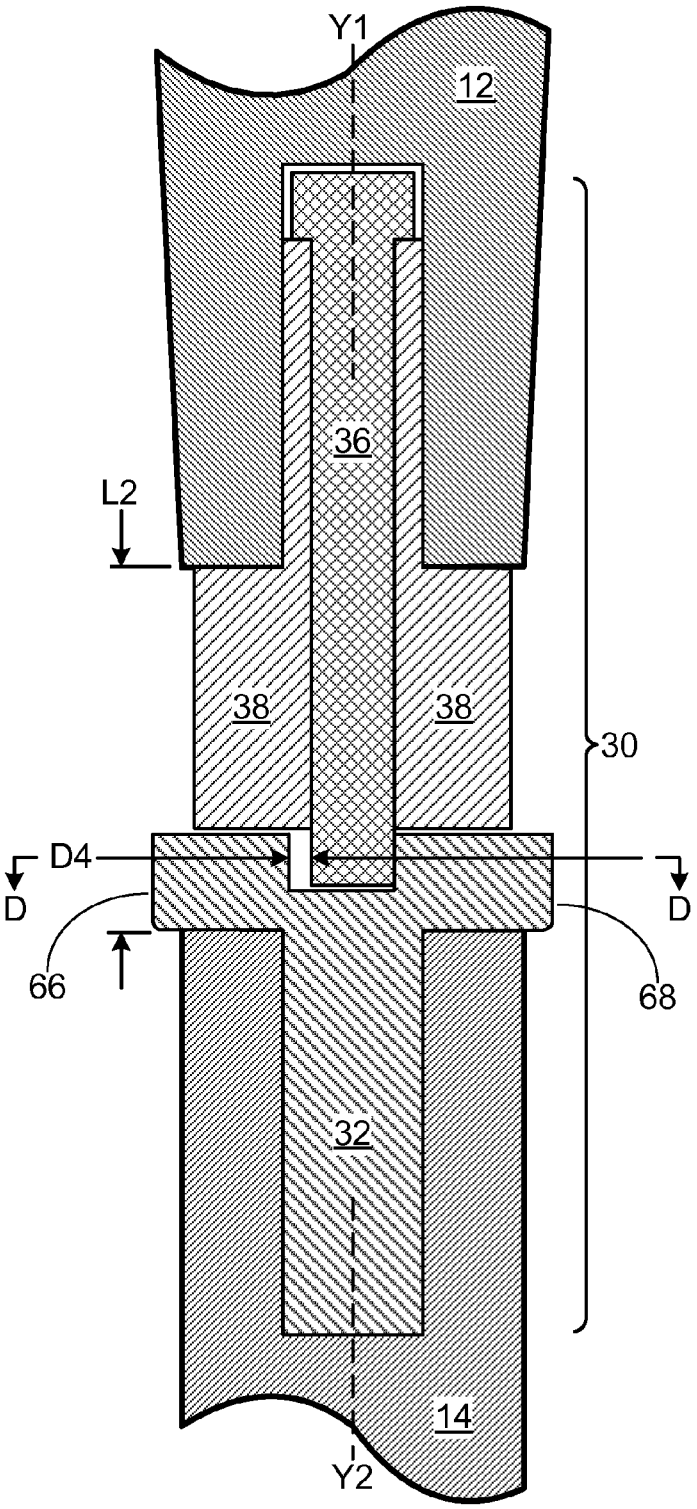
FIG. 4 is a diagram illustrating an enlarged front-facing cross-sectional view, in simplified form, of the slide mechanism shown in FIG. 2 taken along the longitudinal axis of the baseball bat, where the sliding rail assembly includes a sliding rail member and a slide-limiting member that is securely inserted into the sliding rail member.

The training apparatus embodiments described in this section generally include a conventional baseball bat and a slide mechanism which is interposed (e.g., installed) into the bat in a manner that converts the bat into a bat swing training apparatus. More particularly and referring again to FIG. 1, in an exemplary embodiment of the training apparatus described in this section the conventional baseball bat 10 is cut through transversely along its longitudinal axis A-A (e.g., the bat 10 is cut through in a direction that is substantially orthogonal to the axis A-A) approximately at the boundary B-B between the lower end of the barrel section 12 of the bat 10 and the upper end of the handle section 14 of the bat 10, and a small longitudinal section 26 of the bat 10 is removed. In an exemplary implementation of this embodiment the longitudinal section 26 of the bat 10 that is removed has a length L1 that is substantially equal to the radially outer length L2 (illustrated in FIGS. 4-6) of the slide mechanism described in this section. This cutting of the bat 10 thus separates the barrel section 12 from the handle section 14 and forms a gap there-between. After the longitudinal section 26 of the bat 10 has been removed, the slide mechanism is inserted within the just-described gap in a manner that enables the barrel section 12 to move transversely a prescribed small distance relative to the handle section 14 when a batter swings 28 the bat in a desired manner. The fact that the length L1 of the longitudinal section 26 of the bat 10 that is removed is substantially equal to the radially outer length L2 of the slide mechanism is advantageous since it results in the length of the bat after the slide mechanism has been interposed there-within being substantially the same as the original length of the bat before it is cut.

Figure 2:
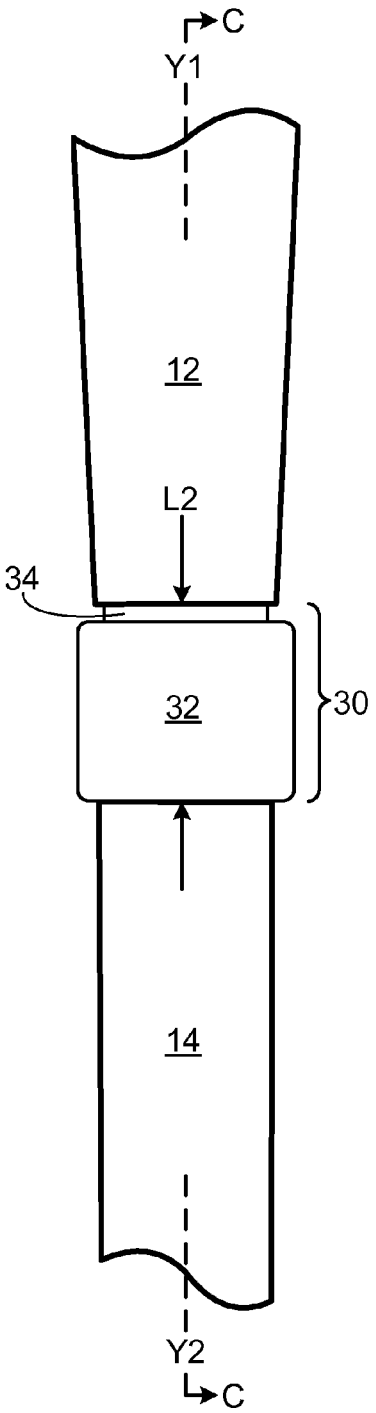
FIG. 2 is a diagram illustrating a plan view, in simplified form, of an exemplary embodiment of a slide mechanism shown connected in-between the lower end of a barrel section of the baseball bat and the upper end of a handle section of the bat, where the slide mechanism includes a sliding rail assembly and a rail guide, the sliding rail assembly is securely connected to this lower end such that the sliding rail assembly and this lower end are substantially coaxial, the rail guide is securely connected to this upper end such that the rail guide and this upper end are substantially coaxial, and the sliding rail assembly is situated in a rightmost position on the rail guide such that these lower and upper ends are substantially coaxial.

FIGS. 2-17 illustrate an exemplary embodiment, in simplified form, of the training apparatus described in this section. More particularly, FIG. 2 illustrates a plan view, in simplified form, of an exemplary embodiment of the slide mechanism 30 shown connected in-between the lower end of the barrel section 12 of the baseball bat and the upper end of the handle section 14 of the bat. As exemplified in FIG. 2, the slide mechanism 30 includes a sliding rail assembly 34 and a rail guide 32. As will be described in more detail hereafter, the sliding rail assembly 34 is securely (e.g., retainably) connected to the lower end of the barrel section 12 in a manner that insures the sliding rail assembly 34 and this lower end are substantially coaxial regardless of how the bat is swung. The rail guide 32 is securely connected to the upper end of the handle section 14 in a manner that insures the rail guide 32 and this upper end are substantially coaxial regardless of how the bat is swung. The sliding rail assembly 34 shown in FIG.

2 is situated in a rightmost position on the rail guide 32 such that the longitudinal axis Y1 of the lower end of the barrel section 12 of the bat is substantially aligned with the longitudinal axis Y2 of the upper end of the handle section 14 of the bat (e.g., these lower and upper ends are substantially coaxial when the sliding rail assembly 34 is situated in the rightmost position). As will be appreciated from the more-detailed description of the slide mechanism 30 that follows, when a batter is holding their bat in preparation to swing it (e.g., when the batter is holding their bat with its barrel section 12 raised behind their head and above one of their shoulders), the sliding rail assembly 34 and the lower end of the barrel section 12 of the bat will naturally move to the rightmost position.

Figure 3:
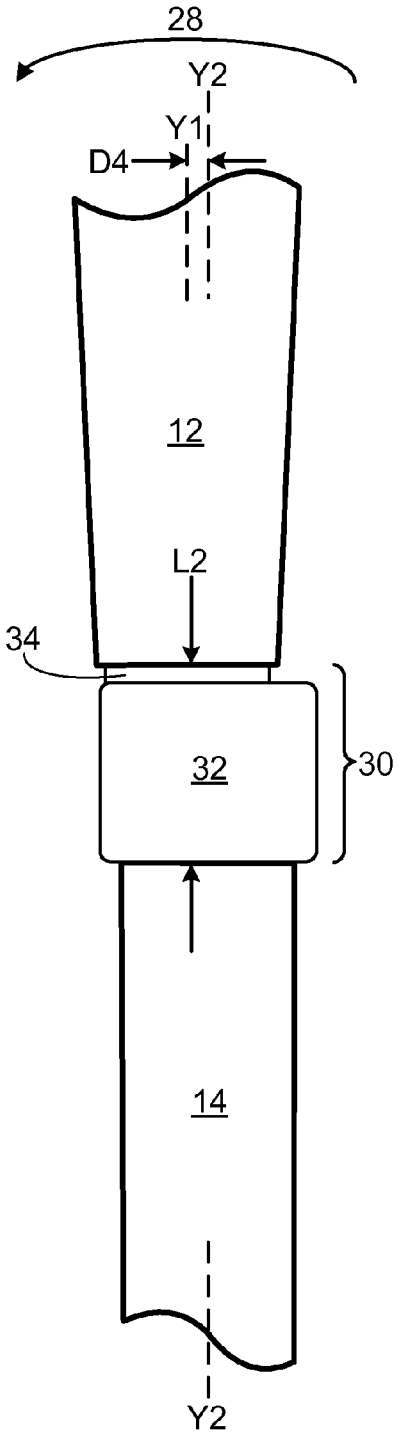
FIG. 3 is a diagram illustrating a plan view, in simplified form, of the slide mechanism of FIG. 2 where the sliding rail assembly is situated in a leftmost position on the rail guide such that the lower end of the barrel section of the baseball bat is transversely offset a prescribed distance from the upper end of the handle section of the bat.
Figure 5:
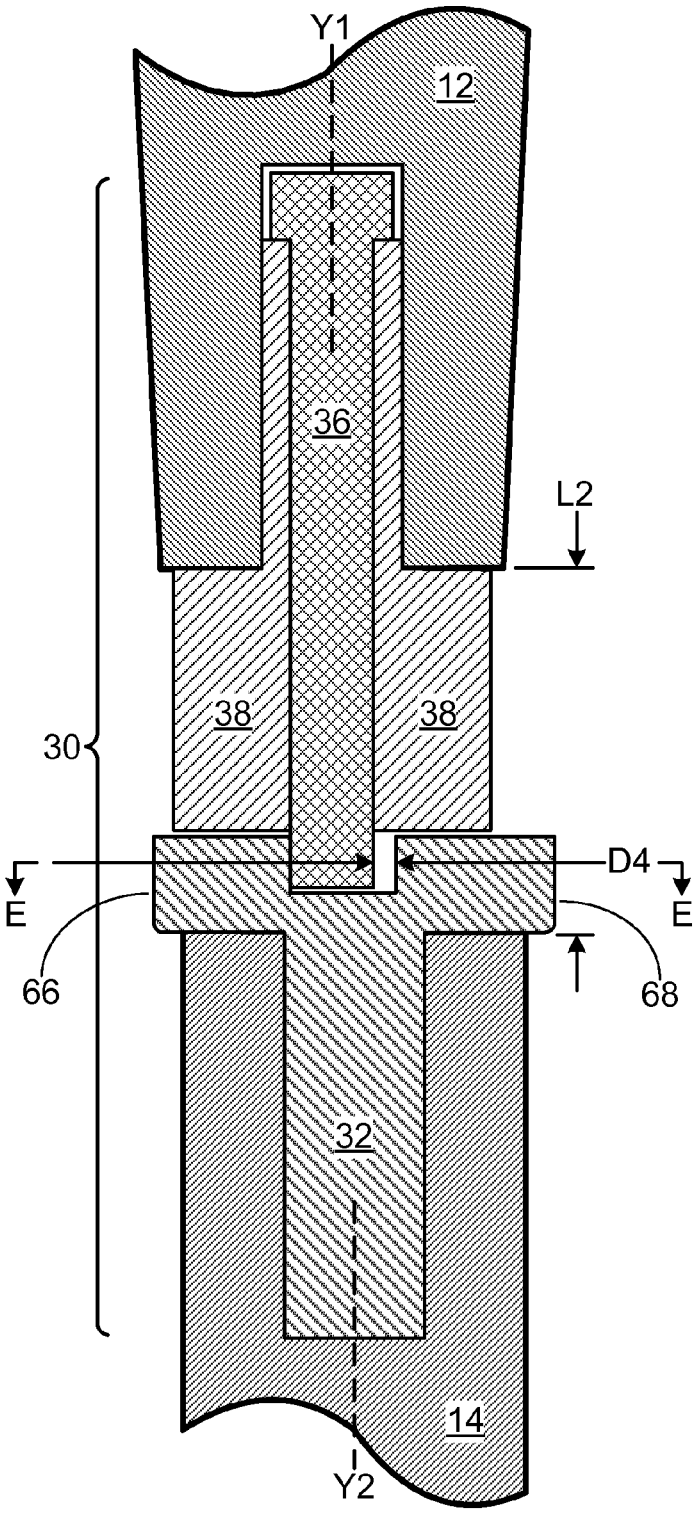
FIG. 5 is a diagram illustrating an enlarged front-facing cross-sectional view, in simplified form, of the slide mechanism shown in FIG. 3 taken along the longitudinal axis of the baseball bat.
Figure 6:
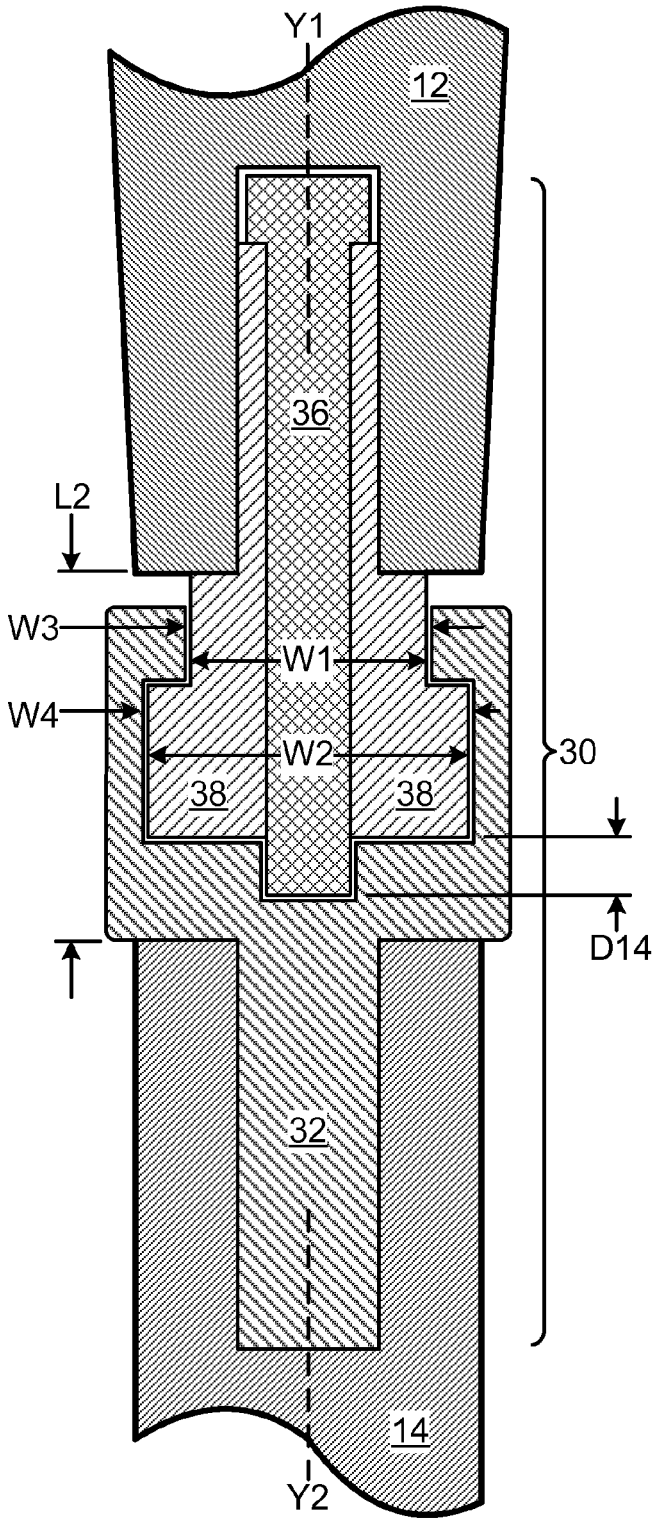
FIG. 6 is a diagram illustrating an enlarged cross-sectional view, in simplified form, of the slide mechanism shown in FIG. 2 taken along line C-C of FIG. 2.
Figure 7:
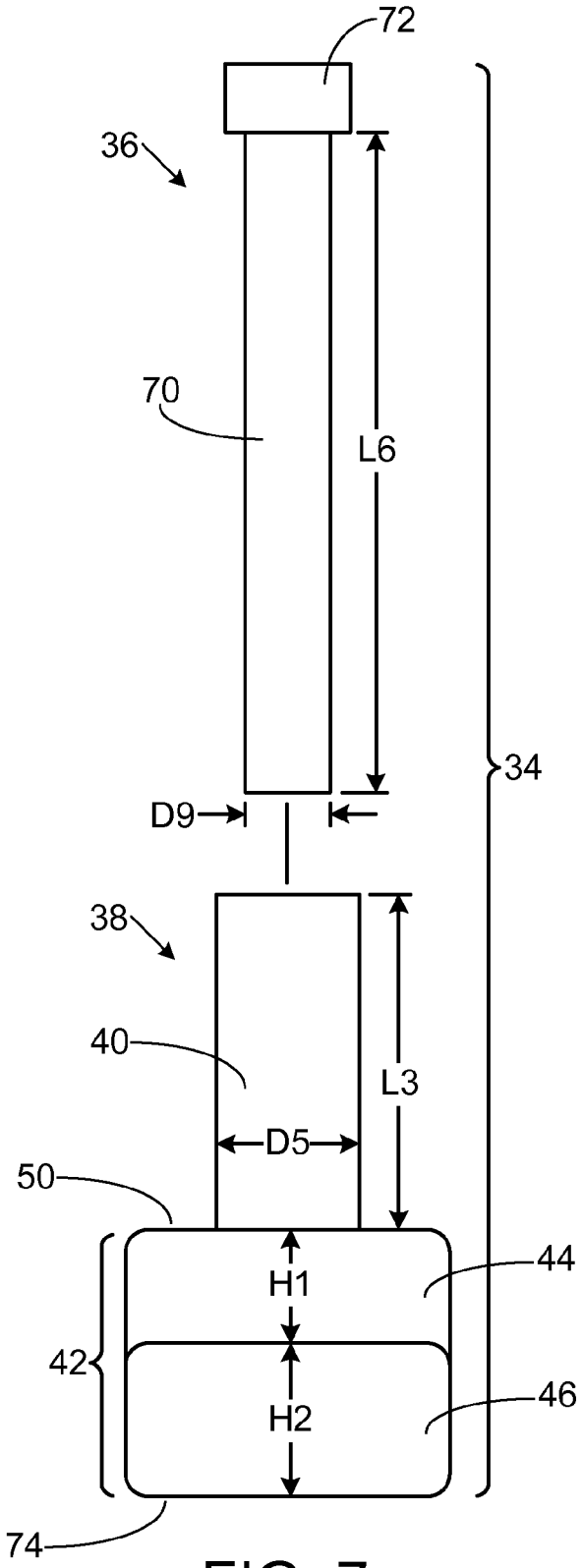
FIG. 7 is a diagram illustrating a standalone exploded plan view, in simplified form, of an exemplary embodiment of the sliding rail assembly of the slide mechanism taken from the perspective of FIGS. 2-5.
Figure 16:
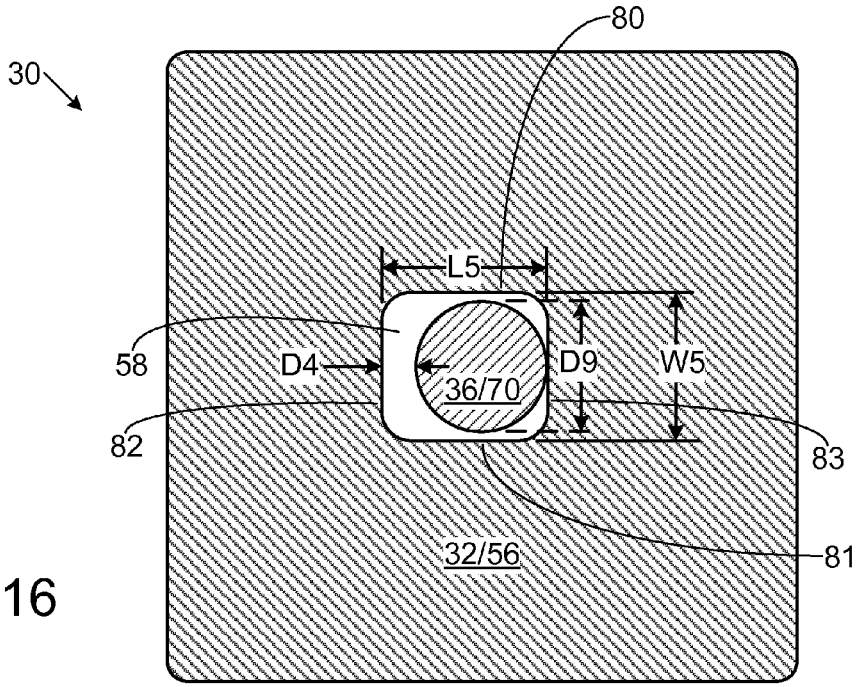
FIG. 16 is a diagram illustrating an enlarged cross-sectional view, in simplified form, of the slide mechanism shown in FIG. 4 taken along line D-D of FIG. 4.
Figure 17:
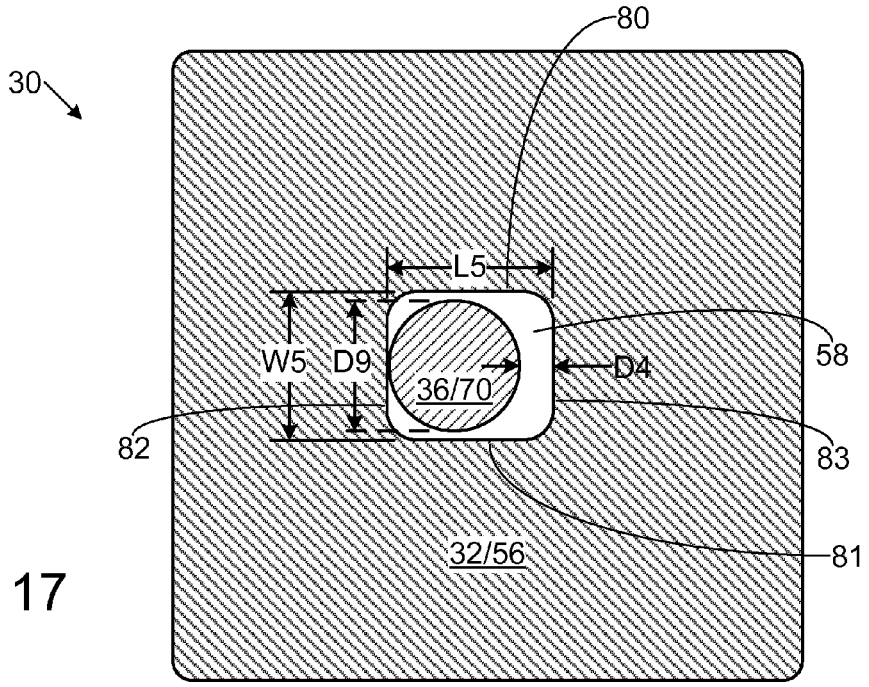
FIG. 17 is a diagram illustrating an enlarged cross-sectional view, in simplified form, of the slide mechanism shown in FIG. 5 taken along line E-E of FIG. 5.

FIG. 3 illustrates a plan view, in simplified form, of the slide mechanism 30 of FIG. 2 where the sliding rail assembly 34 is situated in a leftmost position on the rail guide 32 such that the longitudinal axis Y1 of the lower end of the barrel section 12 of the baseball bat is transversely offset a prescribed maximum rail travel distance D4 from the longitudinal axis Y2 of the upper end of the handle section 14 of the bat. As is described in this section, this transverse offset between the lower end of the barrel section 12 and the upper end of the handle section 14 can be caused by forces incurred during a desired swing 28 of the bat. Referring again to FIG. 1, FIG. 4 illustrates an enlarged front-facing cross-sectional view, in simplified form, of the slide mechanism 30 shown in FIG. 2 taken along the longitudinal axis A-A of the bat 10. FIG. 5 illustrates an enlarged front-facing cross-sectional view, in simplified form, of the slide mechanism 30 shown in FIG. 3 taken along the longitudinal axis A-A of the bat 10. FIG. 6 illustrates an enlarged cross-sectional view, in simplified form, of the slide mechanism 30 shown in FIG. 2 taken along line C-C of FIG. 2. FIG. 7 illustrates a standalone exploded plan view, in simplified form, of an exemplary embodiment of the sliding rail assembly 34 taken from the perspective of FIGS. 2-5. FIG. 16 illustrates an enlarged cross-sectional view, in simplified form, of the slide mechanism 30 shown in FIG. 4 taken along line D-D of FIG. 4. FIG. 17 illustrates an enlarged cross-sectional view, in simplified form, of the slide mechanism shown in FIG. 5 taken along line E-E of FIG. 5. As exemplified in FIGS. 4-7, the sliding rail assembly 34 of the slide mechanism 30 includes a sliding rail member 38 and a slide-limiting member 36 that is securely inserted into a longitudinal aperture that passes from the top of the sliding rail member 38 to the bottom thereof.

Figures 8, 9:
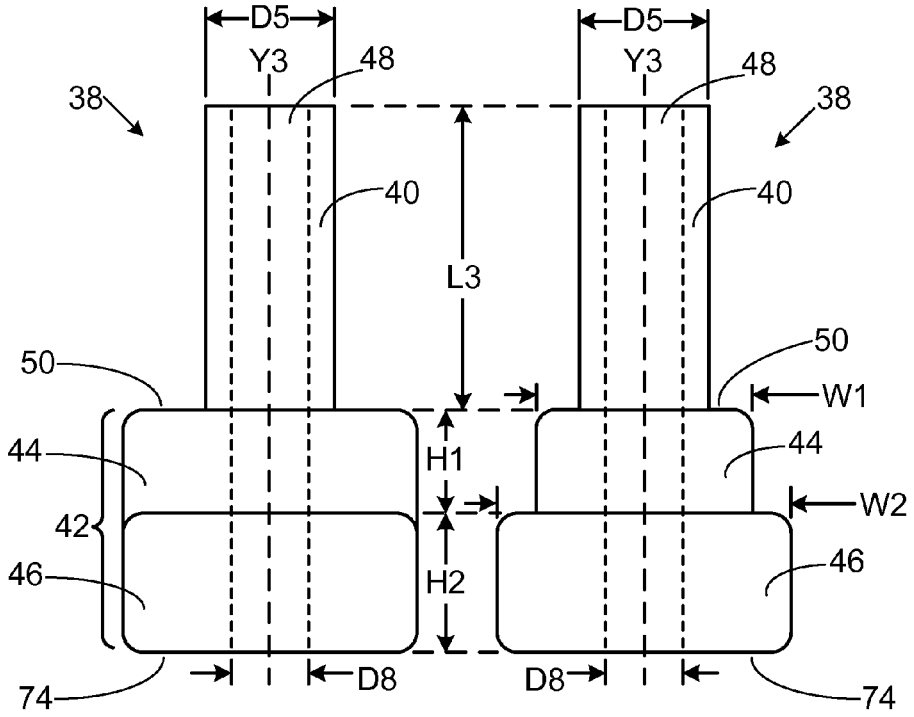
FIG. 8 is a diagram illustrating a standalone transparent plan view, in simplified form, of an exemplary embodiment of the sliding rail member of the sliding rail assembly taken from the perspective of FIGS. 2-5.
FIG. 9 is a diagram illustrating a transparent plan view, in simplified form, of the sliding rail member of FIG. 8 rotated right 90 degrees. In other words.
Figures 10, 11:
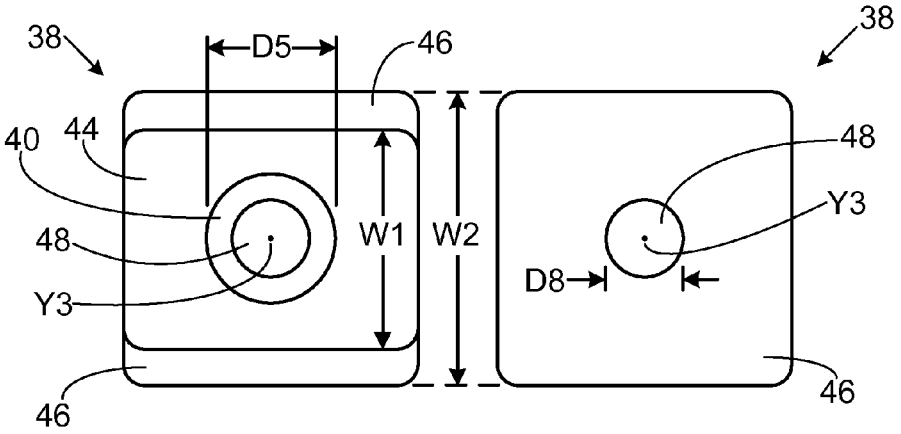
FIG. 10 is a diagram illustrating a top view, in simplified form, of the sliding rail member of FIG. 8.
FIG. 11 is a diagram illustrating a bottom view, in simplified form, of the sliding rail member of FIG. 8.
Figures 12, 13:
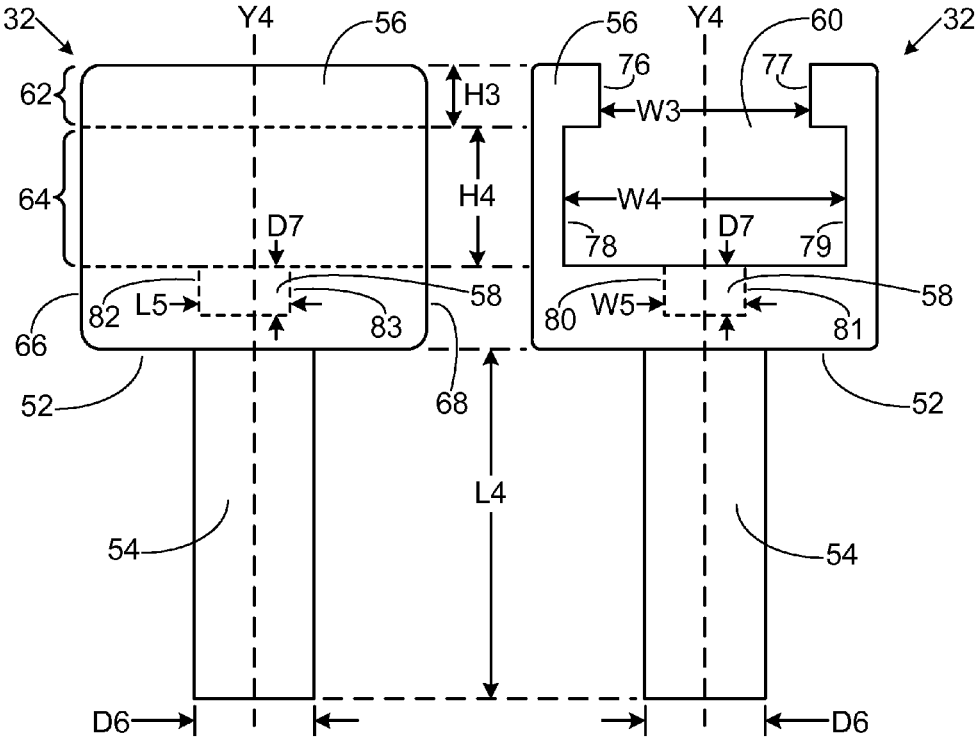
FIG. 12 is a diagram illustrating a standalone transparent plan view, in simplified form, of an exemplary embodiment of the rail guide of the slide mechanism taken from the perspective of FIGS. 2-5.
FIG. 13 is a diagram illustrating a transparent plan view, in simplified form, of the rail guide of FIG. 12 rotated right 90 degrees. In other words.
Figures 14, 15:
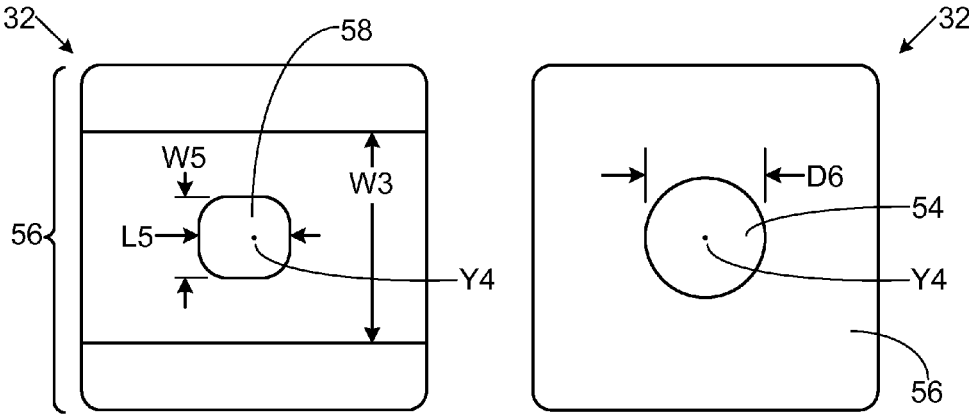
FIG. 14 is a diagram illustrating a top view, in simplified form, of the rail guide of FIG. 12.
FIG. 15 is a diagram illustrating a bottom view, in simplified form, of the rail guide of FIG. 12.

Referring again to FIGS. 2-6, FIG. 8 illustrates a standalone transparent plan view, in simplified form, of an exemplary embodiment of the sliding rail member 38 of the sliding rail assembly 34 taken from the perspective of FIGS. 2-5. FIG. 9 illustrates a transparent plan view, in simplified form, of the sliding rail member 38 of FIG. 8 rotated right 90 degrees. In other words, FIG. 9 illustrates a standalone transparent plan view, in simplified form, of an exemplary embodiment of the sliding rail member 38 taken from the perspective of FIG. 6. FIG. 10 illustrates a top view, in simplified form, of the sliding rail member 38 of FIG. 8. FIG. 11 illustrates a bottom view, in simplified form, of the sliding rail member 38 of FIG. 8. FIG. 12 illustrates a standalone transparent plan view, in simplified form, of an exemplary embodiment of the rail guide 32 of the slide mechanism 30 taken from the perspective of FIGS. 2-5. FIG. 13 illustrates a transparent plan view, in simplified form, of the rail guide 32 of FIG. 12 rotated right 90 degrees. In other words, FIG. 13 illustrates a standalone transparent plan view, in simplified form, of an exemplary embodiment of the rail guide 32 taken from the perspective of FIG. 6. FIG. 14 illustrates a top view, in simplified form, of the rail guide 32 of FIG. 12. FIG. 15 illustrates a bottom view, in simplified form, of the rail guide 32 of FIG. 12.

The training apparatus embodiments described in this section are advantageous for various reasons including, but not limited to, the following. As will be appreciated from the more detailed description that follows and referring again to FIGS. 2-5, the design of the slide mechanism 30 minimizes the weight of the mechanism 30 while maximizing its structural integrity (e.g., its mechanical strength), and provides strong mechanical resistance to bending and possible breakage during the swing 28 of the baseball bat with even the highest likely swing force and speed. As exemplified in FIGS. 2-5, after the slide mechanism 30 has been completely assembled and connected to the barrel and handle sections 12 and 14 of the bat, the slide mechanism 30 permits limited, low-friction, transverse movement of the lower end of the barrel section 12 relative to the upper end of the handle section 14 with substantial mechanical integrity. In other words, the sliding rail assembly 34 and the rail guide 32 of the slide mechanism 30 are cooperatively configured to permit low-friction lateral movement (e.g., a lateral shift) of the lower end of the barrel section 12 relative to the upper end of the handle section 14 during a swinging 28 of the bat, where this lateral movement/motion/shift is confined to a direction that is substantially orthogonal to both the longitudinal axis Y1 of this lower end and the longitudinal axis Y2 of this upper end, and this lateral movement/motion/shift is limited to the maximum rail travel distance D4.

The training apparatus embodiments described in this section are also advantageous for the following reason. As is appreciated in the sport of baseball, wood bats are more flexible than metal bats, and are also generally more flexible than composite and hybrid bats. A batter who has good swing mechanics is able to cause a wood bat to flex when it is swung. This flexing generally occurs midway between the proximal and distal ends of the bat and further increases the speed/power of the barrel section of the bat. Given the foregoing, it will be appreciated that when the slide mechanism is interposed into a metal bat, or a composite bat, or a hybrid bad, the slide mechanism allows the metal/composite/hybrid bat to simulate a wood bat.

As exemplified in FIGS. 4-10, the upper portion of the sliding rail member 38 is adapted to permit the lower end of the barrel section 12 of the bat to be securely connected to this upper portion in a manner that insures this lower end is substantially coaxial with the sliding rail assembly 34 regardless of how the bat is swung. It is noted that this secure connection can be realized in a variety of ways. By way of example but not limitation, in the sliding rail member embodiment that is shown in FIGS. 4-10 this adaptation is configured as follows. The upper portion of the sliding rail member 38 includes a barrel-mating post 40 and the lower portion of the sliding rail member 38 includes a tiered base 42, where the bottom of the barrel-mating post 40 is rigidly disposed onto a central position on the top surface 50 of the tiered base 42 such that the barrel-mating post 40 and the tiered base 42 have a substantially common longitudinal axis Y3 which is substantially orthogonal to the top surface 50, thus insuring that the longitudinal axis Y1 of the lower end of the barrel section 12 is substantially orthogonal to the top surface 50, and insuring that the bottom surface of the barrel section is substantially flush with the top surface 50, when this lower end is connected to the sliding rail member 38.

Referring again to FIGS. 4-10 and as exemplified in FIGS. 4-6, the barrel-mating post 40 has radially cross-sectional shape that is substantially the same as the radially cross-sectional shape of a longitudinal cavity that is formed on the lower end of the barrel section 12 of the bat, where the longitudinal axis of this longitudinal cavity is substantially aligned with the longitudinal axis Y1 of the lower end of the barrel section 12. The barrel-mating post 40 also has a prescribed length L3 and a prescribed diameter D5 that are selected to permit the barrel-mating post 40 to be fully and snugly inserted upward into this longitudinal cavity. In one embodiment of the training apparatus described in this section where the bat has a solid longitudinal interior (which is generally the case for wood bats), the longitudinal cavity can be formed on the lower end of the barrel section 12 after the bat is cut and the aforementioned longitudinal section is removed. In one implementation of this particular embodiment the longitudinal cavity can have a circular radially cross-sectional shape and the radially outer surface of the barrel-mating post 40 can be threaded, thus allowing the secure connection of the lower end of the barrel section 12 to the sliding rail member 38 to be made by threadably inserting the barrel-mating post 40 into the longitudinal cavity. In one version of this particular implementation the threads on the barrel-mating post 40 are formed in a counterclockwise arrangement, which is advantageous since it results in the connection between the lower end of the barrel section 12 and the sliding rail member 38 remaining tight/secure when the bat is swung by a right-handed batter. In another version of this particular implementation the threads on the barrel-mating post 40 are formed in a clockwise arrangement, which is advantageous since it results in the connection between the lower end of the barrel section 12 and the sliding rail member 38 remaining tight/secure when the bat is swung by a left-handed batter. In another implementation of this particular embodiment where the radially outer surface of the barrel-mating post 40 is un-threaded (e.g., substantially smooth), the longitudinal cavity can have any one of a variety of radially cross-sectional shapes (e.g., a circle, a square, a hexagon, and a triangle, among other two-dimensional shapes) and the secure connection of the lower end of the barrel section 12 to the sliding rail member 38 can be made by inserting the barrel-mating post 40 into the longitudinal cavity while a strong adhesive is used to rigidly adhere the radially outer surface of the barrel-mating post 40 to the radial wall of the longitudinal cavity. In another embodiment of the training apparatus where the bat has a hollow longitudinal interior (which is generally the case for metal bats and most composite bats), a longitudinal cavity having a circular radially cross-sectional shape naturally exists on the lower end of the barrel section 12 of the bat, where the longitudinal axis of this longitudinal cavity is substantially aligned with the longitudinal axis of the lower end of the barrel section 12. In an exemplary implementation of this particular embodiment the radially outer surface of the barrel-mating post 40 is un-threaded and the secure connection of the lower end of the barrel section 12 to the sliding rail member 38 is made by inserting the barrel-mating post 40 into the longitudinal cavity while the strong adhesive is used to rigidly adhere the radially outer surface of the barrel-mating post 40 to the radial wall of the longitudinal cavity. It will be appreciated that various types of adhesives can be used. In an exemplary implementation of the slide mechanism 30 the adhesive is an epoxy.

As exemplified in FIGS. 4-6, 12, 13 and 15, the lower portion of the rail guide 32 is adapted to permit the upper end of the handle section 14 of the bat to be securely connected to this lower portion in a manner that insures this upper end is substantially coaxial with the rail guide 32 regardless of how the bat is swung. It is noted that this secure connection can be realized in a variety of ways. By way of example but not limitation, in the rail guide embodiment that is shown in FIGS. 4-6, 12, 13 and 15 this adaptation is configured as follows. The lower portion of the rail guide 32 includes a handle-mating post 54 and the upper portion of the rail guide 32 includes a guide block 56, where the top of the handle-mating post 54 is rigidly disposed onto a central position on the bottom surface 52 of the rail guide block 56 such that the handle-mating post 54 and the guide block 56 have a substantially common longitudinal axis Y4 which is substantially orthogonal to the bottom surface 52, thus insuring that the longitudinal axis Y2 of the upper end of the handle section 14 is substantially orthogonal to the bottom surface 52, and insuring that the top surface of the handle section is substantially flush with the bottom surface 52, when this upper end is connected to the rail guide 32.

Referring again to FIGS. 4-6, 12, 13 and 15 and as exemplified in FIGS. 4-6, the handle-mating post 54 has radially cross-sectional shape that is substantially the same as the radially cross-sectional shape of a longitudinal cavity that is formed on the upper end of the handle section 14 of the bat, where the longitudinal axis of this longitudinal cavity is substantially aligned with the longitudinal axis Y2 of the upper end of the handle section 14. The handle-mating post 54 also has a prescribed length L4 and a prescribed diameter D6 that are selected to permit the handle-mating post 54 to be fully and snugly inserted downward into this longitudinal cavity. In the aforementioned embodiment of the training apparatus described in this section where the bat has a solid longitudinal interior, the longitudinal cavity can be formed on the upper end of the handle section 14 after the bat is cut and the aforementioned longitudinal section is removed. In one implementation of this particular embodiment the longitudinal cavity can have a circular radially cross-sectional shape and the radially outer surface of the handle-mating post 54 can be threaded, thus allowing the secure connection of the upper end of the handle section 14 to the rail guide 32 to be made by threadably inserting the handle-mating post 54 into the longitudinal cavity. In one version of this particular implementation the threads on the handle-mating post 54 are formed in a counterclockwise arrangement, which is advantageous since it results in the connection between the upper end of the handle section 14 and the rail guide 32 remaining tight/secure when the bat is swung by a right-handed batter. In another version of this particular implementation the threads on the handle-mating post 54 are formed in a clockwise arrangement, which is advantageous since it results in the connection between the upper end of the handle section 14 and the rail guide 32 remaining tight/secure when the bat is swung by a left-handed batter. In another implementation of this particular embodiment where the radially outer surface of the handle-mating post 54 is un-threaded, the longitudinal cavity can have any one of a variety of radially cross-sectional shapes (e.g., a circle, a square, a hexagon, and a triangle, among other two-dimensional shapes) and the secure connection of the upper end of the handle section 14 to the rail guide 32 can be made by inserting the handle-mating post 54 into the longitudinal cavity while the aforementioned strong adhesive is used to rigidly adhere the radially outer surface of the handle-mating post 54 to the radial wall of the longitudinal cavity. In the aforementioned other embodiment of the training apparatus where the bat has a hollow longitudinal interior, a longitudinal cavity having a circular radially cross-sectional shape naturally exists on the upper end of the handle section 14 of the bat, where the longitudinal axis of this longitudinal cavity is substantially aligned with the longitudinal axis of the upper end of the handle section 14. In an exemplary implementation of this particular embodiment the radially outer surface of the handle-mating post 54 is un-threaded and the secure connection of the upper end of the handle section 14 to the rail guide 32 is made by inserting the handle-mating post 54 into the longitudinal cavity while the strong adhesive is used to rigidly adhere the radially outer surface of the handle-mating post 54 to the radial wall of the longitudinal cavity.

As exemplified in FIGS. 6 and 12-14, the upper portion of the guide block 56 of the rail guide 32 includes a tiered linear guide channel 60 that passes from the left side 66 of the guide block to the right side 68 of the guide block. The guide channel 60 includes an upper channel tier 62 and a lower channel tier 64, where the vertical axis of both the upper and lower channel tiers 62 and 64 is substantially aligned with the aforementioned common longitudinal axis Y4. The upper channel tier 62 of the guide block 56 has a pair of parallel opposing sidewalls 76 and 77, a prescribed width W3, and a prescribed height H3. The lower channel tier 64 of the guide block 56 has another pair of parallel opposing sidewalls 78 and 79, a prescribed width W4 that is greater than width W3, and a prescribed height H4. Generally speaking and as exemplified in FIGS. 6-10, the tiered base 42 of the sliding rail member 38 has a shape and size that are adapted to permit the tiered base to slidably mate with the tiered linear guide channel 60 of the guide block 56. More particularly, the tiered base 42 includes an upper base tier 44 and a lower base tier 46, where the vertical axis of both the upper and lower base tiers 44 and 46 is substantially aligned with the aforementioned common longitudinal axis Y3. The upper base tier 44 of the tiered base 42 has parallel opposing sidewalls, a prescribed width W1 that is slightly less than the width W3, and a prescribed height H1 that is greater than the height H3. The lower base tier 46 of the tiered base 42 also has parallel vertical sidewalls, a prescribed width W2 that is slightly less than the width W4, and a prescribed height H2 that is slightly less than the height H4. Accordingly, the tiered linear guide channel 60 of the rail guide 32 is adapted to receive the tiered base 42 of the sliding rail member 38 in low-friction sliding engagement when the tiered base is slidably inserted into the guide channel, where this sliding engagement permits the sliding rail member (and thus the sliding rail assembly 34) to slide/travel in a direction that is substantially orthogonal to both the longitudinal axis Y3 of the sliding rail member (and thus the longitudinal axis of the sliding rail assembly 34) and the longitudinal axis Y4 of the rail guide.

Referring again to FIGS. 6-10 and 12-14, in an exemplary implementation of the training apparatus embodiments described herein the difference between the just-described widths W1 and W3 is greater than or equal to 0.01 millimeters (0.00039 inches) and less than or equal to 0.02 millimeters (0.00079 inches), the difference between the just-described widths W2 and W4 is also greater than or equal to 0.01 millimeters (0.00039 inches) and less than or equal to 0.02 millimeters (0.00079 inches), and the difference between the just-described heights H2 and H4 is also greater than or equal to 0.01 millimeters (0.00039 inches) and less than or equal to 0.02 millimeters (0.00079 inches). As exemplified in FIGS. 7-11, each of the edges, and thus each of the corners, of the tiered base 42 of the sliding rail member 38 can be rounded; these rounded edges and corners are advantageous in that they reduce the friction with the rail guide's 32 tiered linear guide channel 60 when the tiered base 42 is slidably mated therewith; these rounded edges and corners are also advantageous in that they prevent injury to the batter and reduce the weight of the slide mechanism 30. As exemplified in FIGS. 4-6 and 12-15, each of the exterior edges, and thus each of the exterior corners, of the guide block 56 of the rail guide 32 can be rounded; these rounded exterior edges and corners are advantageous in that they also prevent injury to the batter and reduce the weight of the slide mechanism 30. In order to further reduce the friction between the sliding rail member's tiered base 42 and the rail guide's guide channel 60 a small amount of lubricant having a low coefficient of friction (e.g., a high degree of lubricity) can optionally be applied to the tiered base before it is slidably inserted into the guide channel. It will be appreciated that various different low friction lubricants can be employed such as graphite, and various types oils and greases, among others.

As exemplified in FIGS. 4-6, 12-14, 16 and 17, the guide block 56 of the rail guide 32 also includes a rail travel distance limiting cavity 58 that is located on the bottom surface of the lower channel tier 64 of the rail guide's guide channel 60. The rail travel distance limiting cavity 58 has a prescribed width W5, a prescribed length L5, and a prescribed depth D7. As exemplified in FIGS. 8-11, the sliding rail member 38 includes a longitudinal aperture 48 that passes from the top of the sliding rail member to the bottom thereof, where the longitudinal axis of this aperture 48 is substantially aligned with the common longitudinal axis Y3 of both the barrel-mating post 40 and the tiered base 42 of the sliding rail member. In other words, the aperture 48 is substantially coaxial with both the barrel-mating post 40 and the tiered base 42, and passes from the top of the barrel-mating post, through the barrel-mating post, through the tiered base, to the bottom of the lower base tier 46 of the tiered base. The aperture 48 has a prescribed radially cross-sectional shape and a prescribed diameter D8. As exemplified in FIGS. 4-7, the slide-limiting member 36 that is securely inserted into the longitudinal aperture 48 includes an aperture-mating post 70 and a head 72 that is rigidly disposed onto the top of the post 70. The post 70 has a radially cross-sectional shape that is substantially the same as the radially cross-sectional shape of the aperture 48. The post 70 also has a prescribed length L6 and a prescribed diameter D9 that are selected to permit the post 70 to be fully and securely inserted downward into the aperture 48 so that the post 70 protrudes a prescribed distance D14 from the bottom surface 74 of the tiered base 42 (e.g., the bottom of the lower base tier 46).

Referring again to FIGS. 6-11, in one implementation of the slide mechanism 30 the longitudinal aperture 48 can have a circular radially cross-sectional shape and can be threaded, and the radially outer surface of the aperture-mating post 70 can also be threaded in a manner that permits the post 70 to be threadably connected to the aperture 48, thus allowing the secure insertion of the slide-limiting member 36 into the sliding rail member 38 to be made by threadably fully inserting the post 70 into the aperture 48. In this particular implementation a lock-washer (not shown) can optionally be disposed onto the post 70 before it is threadably fully inserted into the aperture 48; when the post 70 is threadably fully inserted into the aperture 48 the lock-washer will become sandwiched between the bottom of the head 72 of the post 70 and the top of the barrel-mating post 40. In another implementation of the slide mechanism 30 where the aperture 48 is un-threaded and the radially outer surface of the post 70 is un-threaded, the aperture 48 can have any one of a variety of radially cross-sectional shapes (e.g., a circle, a square, and a hexagon, among other two-dimensional shapes) and the secure insertion of the slide-limiting member 36 into the sliding rail member 38 can be made by inserting the post 70 into the aperture 48 while the aforementioned strong adhesive is used to rigidly adhere the radially outer surface of the post 70 to the radial wall of the aperture 48.

As will be appreciated from FIGS. 4-6, 16 and 17 and the functional operation of the slide mechanism 30 described herein, and referring again to FIGS. 7-14, the aperture-mating post 70 of the slide-limiting member 36 is not inserted into the longitudinal aperture 48 on the sliding rail member 38 until after the tiered base 42 of the sliding rail member has been slidably inserted into the tiered linear guide channel 60 on the guide block 56 of the rail guide 32. As such, the bottom of the post 70 protrudes into the aforementioned rail travel distance limiting cavity 58 that is located on the bottom surface of the guide channel's 60 lower channel tier 64. As will now be described in more detail, this cavity 58 is adapted to limit the travel of the sliding rail assembly 54 (e.g., limit the aforementioned lateral movement/motion/shift) to the maximum rail travel distance D4 by limiting the travel of the post 70 to this distance D4. More particularly, the cavity 58 has one pair of opposing vertical sidewalls 80 and 81 that are substantially parallel to each other and to the vertical sidewalls 76-79 of the guide channel's upper and lower tiers 62 and 64. The cavity 58 has another pair of opposing vertical sidewalls 82 and 83 that are substantially parallel to each other and are substantially orthogonal to the direction of slide/travel of the sliding rail member 38 and thus the slide-limiting member 36. As exemplified in FIGS. 4-6, the depth D7 of the cavity 58 is greater than the aforementioned distance D14 that the post 70 of the slide-limiting member 36 protrudes from the bottom surface 74 of the tiered base 42 after the post 70 has been fully inserted into the aperture 48. As exemplified in FIGS. 6, 16 and 17, both the width W5 and length L5 of the cavity 58 are greater than the diameter D9 of the post 70 of the slide-limiting member 36, thus permitting the post 70 to travel laterally (e.g., leftward and rightward from the perspective of FIGS. 4, 5, 16 and 17) within the cavity 58. As will be appreciated from FIGS. 16 and 17, the difference between the length L5 and the diameter D9 defines the distance D4. When the sliding rail assembly 34 is situated in the aforementioned rightmost position on the rail guide 32 the right side of the post 70 makes contact with the sidewall 83 as exemplified in FIG. 16. When the sliding rail assembly 34 is situated in the aforementioned leftmost position on the rail guide 32 the left side of the post 70 makes contact with the sidewall 82 as exemplified in FIG. 17. Generally speaking, the length L5 and the diameter D9 can be selected so that the distance D4 can have any value, where this value is selected based on the stiffness of the bat, among other factors. By way of example but not limitation, in one embodiment of the slide mechanism 30 the length L5 and the diameter D9 are selected so that the distance D4 is approximately 5.0 millimeters (0.19685 inches).

Referring again to FIGS. 1-5, 16 and 17, the training apparatus embodiments described in this section are further advantageous since the slide mechanism 30 permits the batter to hear and feel the transverse movement of the bat's barrel section 12 relative to the bat's handle section 14 when the batter swings 28 the bat 10 in a desired manner. In other words, when the slide mechanism 30 is interposed into the bat 10 as described heretofore, the mechanism provides the batter with both audible and tactile feedback indicating whether or not they have achieved a desired swing 28 profile. For example, when the bat is swung 28 in a manner that makes the lower end of the bat's barrel section 12 laterally shift leftward relative to the upper end of the bat's handle section 14 such that the sliding rail assembly 34 reaches the leftmost position on the rail guide 32 and the left side of the aperture-mating post 70 impacts the sidewall 82 of the rail travel distance limiting cavity 58, the slide mechanism 30 will generate a discernible sound (e.g., the batter will hear a "click" sound) and will also generate a tactile sensation at the proximal end 24 of the bat (e.g., the batter will feel a vibration that travels from the mechanism 30 through the bat's handle section 14 and into their hands). In the aforementioned embodiment of the training apparatus where the bat 10 has a hollow longitudinal interior, a distal sound-emanating aperture (not shown) can be added to the distal end 22 of the bat and/or a proximal sound-emanating aperture (not shown) can be added to the proximal end 24 of the bat. The distal and proximal sound-emanating apertures are advantageous since they serve to increase the volume of the just-described "click" sound that is heard by the batter.

Figure 18:
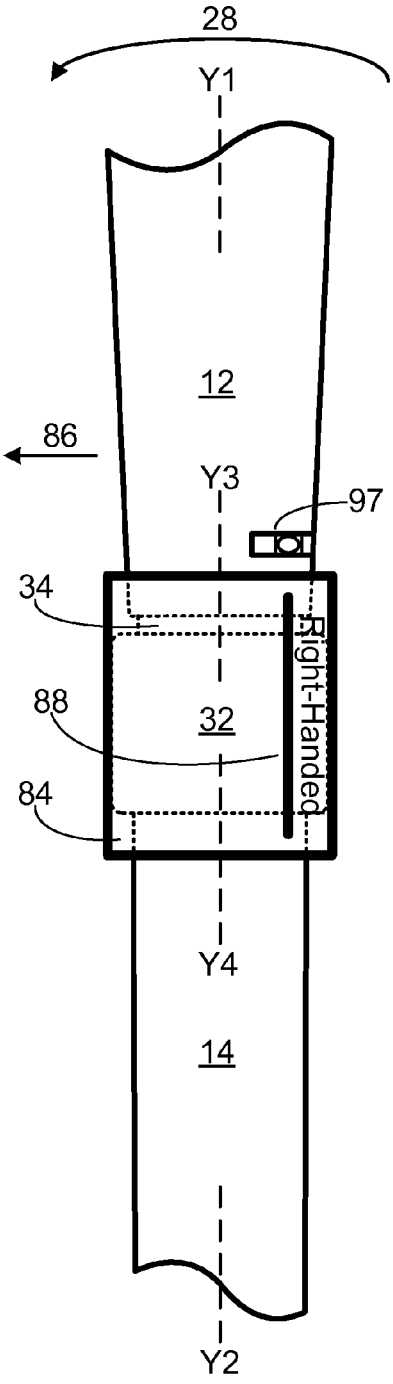
FIG. 18 is a diagram illustrating a transparent plan view, in simplified form, of one embodiment of a protective sleeve that can be disposed around the slide mechanism after it has been connected in-between the lower end of the barrel section of the baseball bat and the upper end of the handle section of the bat.
Figure 19:
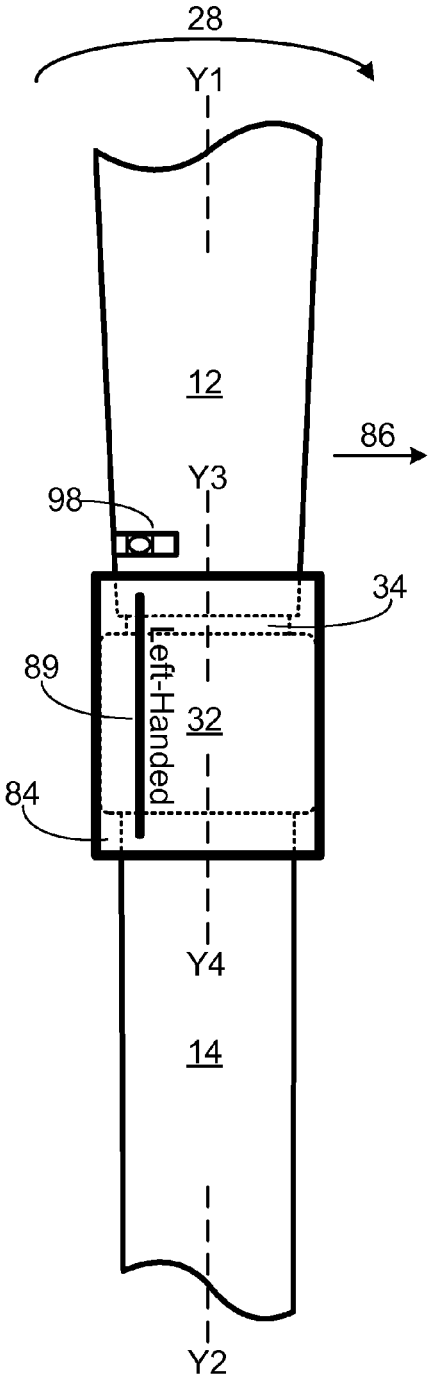
FIG. 19 is a diagram illustrating a transparent plan view, in simplified form, of the protective sleeve and slide mechanism of FIG. 18 rotated right 180 degrees.

FIG. 18 illustrates a transparent plan view, in simplified form, of one embodiment of a protective sleeve that can optionally be disposed around the slide mechanism after it has been connected in-between the lower end of the barrel section of the baseball bat and the upper end of the handle section of the bat. FIG. 19 illustrates a transparent plan view, in simplified form, of the protective sleeve and slide mechanism of FIG. 18 rotated right 180 degrees. As exemplified in FIGS. 18 and 19, the protective sleeve 84 is disposed around the sliding rail assembly 34 and the rail guide 32 of the slide mechanism in a manner that covers the slide mechanism, overlaps the bottommost portion of the lower end of the barrel section 12 of the bat, and also overlaps the topmost portion of the upper end of the handle section 14 of the bat. The protective sleeve 84 is durable and resiliently flexible, and thus permits the transverse movement 86 of the bat's barrel section 12 relative to the bat's handle section 14 when the batter swings 28 the bat in a desired manner. As shown in FIG. 18, when a right-handed batter swings 28 the bat leftward (e.g., from their right to their left) this transverse movement 86 occurs in a leftward direction. As shown in FIG. 19, when a left-handed batter swings 28 the bat rightward (e.g., from their left to their right) this transverse movement 86 occurs in a rightward direction. The protective sleeve 84 can be made from any of a variety of materials that are durable and resiliently flexible (e.g., rubber, or the like). The protective sleeve 84 serves various purposes including, but not limited to, the following. The protective sleeve 84 protects the slide mechanism from being damaged when the bat is thrown or dropped by the batter, or when the mechanism is hit by a ball, or when the bat is put into a bag with other bats and other types of baseball gear, or the like. The protective sleeve also prevents foreign materials (such as sand, rocks, dust, and the like) from entering the slide mechanism.

Referring again to FIG. 18, the protective sleeve 84 can include a visible line 88 that is imprinted on the radially exterior surface of the sleeve, where this line 88 is substantially parallel to the longitudinal axis Y4 of the rail guide 32, and is located approximately 135 degrees radially to the right of the direction of the transverse movement 86 (e.g., the lateral shift) of the bat's barrel section 12 relative to the bat's handle section 14. The line 88 serves various purposes including, but not limited to, the following. If the line 88 is not substantially straight, this indicates that something may be wrong with the slide mechanism and it may have to be serviced (e.g., the connection between the sliding rail assembly 34 and the bat's barrel section 12 may have loosened, or the connection between the rail guide 32 and the bat's handle section 14 may have loosened). The line 88 also provides a right-handed batter with an indication of how they should hold the handle section 14. More particularly, the right-handed batter should grip the handle section 14 in a manner that insures the line 88 is facing the right-handed batter (e.g., the line 88 is oriented upward) as they hold the bat. As shown in FIG. 18, a text string (e.g., "Right-Handed") can be imprinted on the radially exterior surface of the sleeve 84 adjacent to the line 88, where this text string indicates that the line 88 applies to right-handed batters. It will be appreciated that the line 88 and text string can be imprinted on the radially exterior surface of the sleeve 84 in various ways (e.g., they can be either molded into the sleeve, or painted on the sleeve, among other ways).

Referring again to FIG. 19, the protective sleeve 84 can also include another visible line 89 that is imprinted on the radially exterior surface of the sleeve, where this line 89 is also substantially parallel to the longitudinal axis Y4 of the rail guide 32, and is located diametrically opposite the visible line 88. The line 89 serves various purposes including, but not limited to, the following. If the line 89 is not substantially straight, this indicates that something may be wrong with the slide mechanism and it may have to be serviced. The line 89 also provides a left-handed batter with an indication of how they should hold the handle section 14. More particularly, the left-handed batter should grip the handle section 14 in a manner that substantially aligns the thumb of their left hand with the line 89, thus insuring that the line 89 is facing the left-handed batter as they hold the bat. As shown in FIG. 19, another text string (e.g., "Left-Handed") can be imprinted on the radially exterior surface of the sleeve 84 adjacent to the line 89, where this text string indicates that the line 89 applies to left-handed batters. It will be appreciated that the line 89 and text string can be imprinted on the radially exterior surface of the sleeve 84 in various ways (e.g., the line 89 can be either molded into the sleeve, or painted on the sleeve, among other ways).

Figure 20:
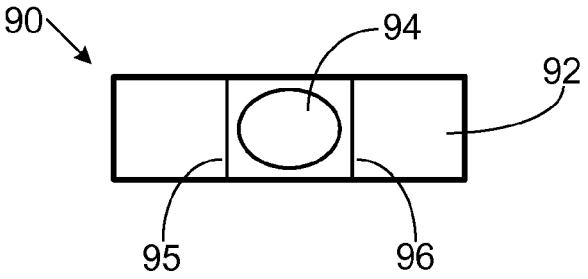
FIG. 20 is a diagram illustrating a top plan view, in simplified form, of an exemplary embodiment of a conventional tubular spirit level that can be employed in the training apparatus embodiments described herein.

FIG. 20 illustrates a top plan view, in simplified form, of an exemplary embodiment of a conventional tubular spirit level (also known as a bubble level or simply a level) one or more of which can be employed in the training apparatus embodiments described herein. Generally speaking and as is appreciated in the art of carpentry (among many other arts that utilize spirit levels), a spirit level is an instrument designed to indicate to a user whether or not a given surface that the level is either attached to or resting on is in a prescribed orientation (e.g., horizontal/level or vertical/plumb). The tubular spirit level 90 shown in FIG. 20 includes a transparent tubular vial 92 that is sealed at both ends and is incompletely filled with liquid, thus leaving a bubble 94 within the vial. The spirit level 90 also includes a pair of substantially parallel indicator lines 95 and 96 that are imprinted on the vial 92, where these lines 95 and 96 are spaced apart a distance that is slightly larger than the length of bubble 94.

As exemplified in FIG. 18, one spirit level 97 can be securely attached to the radially exterior surface of the bat's barrel section 12 near the lower end thereof (e.g., just above the protective sleeve 84), where the level 97 is located at a position that allows an imaginary line which is substantially parallel to the longitudinal axis Y4 of the rail guide 32, and is located approximately 135 degrees radially to the right of the direction of the transverse movement 86 of the bat's barrel section 12 relative to the bat's handle section 14, to pass midway between the level's indicator lines (e.g., the level's 97 indicator lines would be substantially centered about the axis of the visible line 88 in the case where this line is imprinted on the sleeve 84 and the sliding rail assembly 34 is situated in its rightmost position on the rail guide 32). The spirit level 97 provides a right-handed batter with another indication of how they should hold the handle section 14. More particularly, the right-handed batter should grip the handle section 14 in a manner that locates the bubble within the vial of the spirit level 97 within the parallel indicator lines that are imprinted on this vial. In the case where the aforementioned text string (e.g., "Right-Handed") is not imprinted on the sleeve 84, a similar text string can be imprinted above the spirit level 97 in order to indicate that it applies to right-handed batters.

As exemplified in FIG. 19 and referring again to FIG. 18, another spirit level 98 can also be securely attached to the radially exterior surface of the bat's barrel section 12 near the lower end thereof (e.g., just above the protective sleeve 84), where the level 98 is located at a position that is diametrically opposite the spirit level 97 (e.g., the level's 98 indicator lines would be substantially centered about the axis of the visible line 89 in the case where this line is imprinted on the sleeve 84 and the sliding rail assembly 34 is situated in its rightmost position on the rail guide 32, which equates to its leftmost position from the perspective of FIG. 19). The spirit level 98 provides a left-handed batter with another indication of how they should hold the handle section 14. More particularly, the left-handed batter should grip the handle section 14 in a manner that locates the bubble within the vial of the spirit level 98 within the parallel indicator lines that are imprinted on this vial. In the case where the aforementioned text string (e.g., "Left-Handed") is not imprinted on the sleeve 84, a similar text string can be imprinted above the spirit level 98 in order to indicate that it applies to left-handed batters.

Referring again to FIG. 1, it will be appreciated that the inherent weight of the slide mechanism, and also the inherent weight of the protective sleeve and spirit levels to a smaller degree, can change the balance point of the bat 10 which may be disadvantageous, where the degree of this change depends on the actual weight of the mechanism, sleeve, and spirit levels, and the particular location along the bat's longitudinal axis A-A where the mechanism is interposed. In order to counter-balance the weight of the slide mechanism after it has been interposed into the bat 10 and also counter-balance the weight of the protective sleeve and spirit levels, a counterweight member (not shown) can optionally be securely attached to the proximal end 24 of the bat. It is noted that various embodiments of the counterweight member are possible, examples of which will now be provided. In one embodiment of the training apparatus described in this section the counterweight member can be securely disposed (e.g., glued, or the like) onto the bottom end of the knob 16 on the bat's handle section 14. In another embodiment of the training apparatus the counterweight member can include a threaded shaft which is threadably inserted into a mating aperture that is formed on the bottom end of the knob 16. In yet another embodiment of the training apparatus the counterweight member can be implemented in the form of a ring which is sized to allow it to be securely disposed around the circumference of the knob 16. Usage of the counterweight member is advantageous since it serves to recreate the original balance point of the bat 10 after the slide mechanism has been interposed into the bat. The counterweight member can have various different weights, where the particular weight that is chosen depends on various factors such as the type of bat 10 the slide mechanism is being interposed into, the weight of the bat, the particular location on the bat where the slide mechanism is interposed, the weight of the slide mechanism, and the weight of the protective sleeve and spirit levels, among other factors.

2.1 Non-Sliding Member

Figure 21:
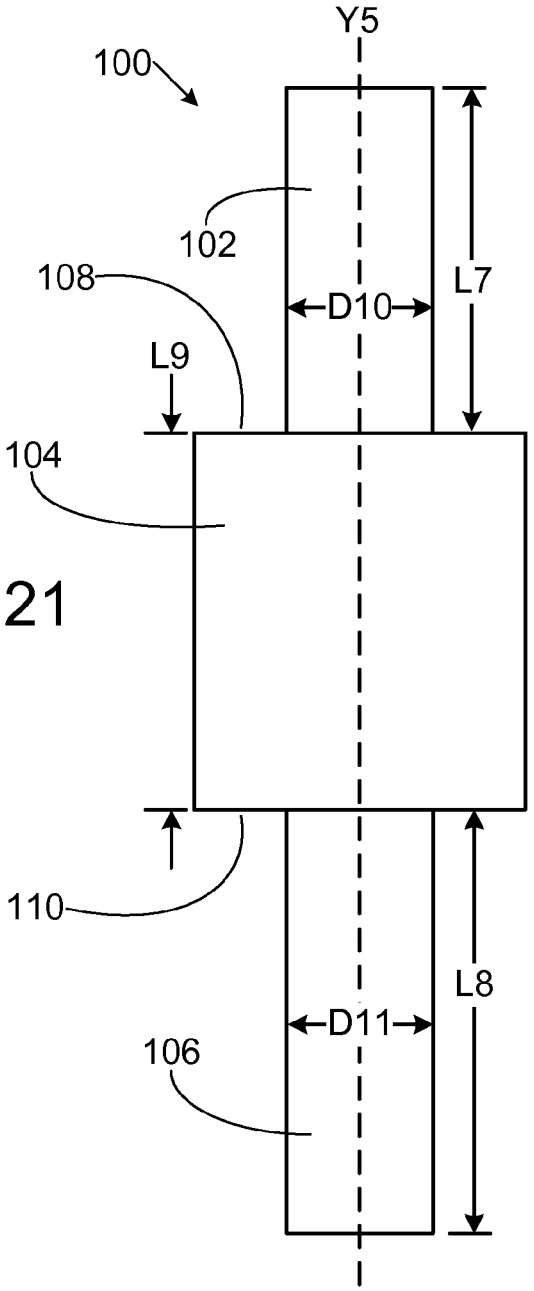
FIG. 21 is a diagram illustrating a standalone plan view, in simplified form, of an exemplary embodiment of a non-sliding member that is adapted to replace the slide mechanism that is interposed into the baseball bat and maintain the lower end of the bat's barrel section in substantial coaxial alignment with the upper end of the bat's handle section at all times regardless of how the bat is swung.

FIG. 21 illustrates a standalone plan view, in simplified form, of an exemplary embodiment of a non-sliding member that is adapted to replace a slide mechanism that is interposed into a baseball bat as described heretofore and maintain the lower end of the bat's barrel section in substantial coaxial alignment with the upper end of the bat's handle section at all times regardless of how the bat is swung, thus converting the bat back into its original form and functionality. Referring again to FIGS. 4, 8 and 12, it is noted that this particular embodiment of the non-sliding member 100 is applicable to the aforementioned training apparatus embodiment where the bat has a solid longitudinal interior, the barrel-mating post 40 of the slide mechanism's sliding rail member 38 has a circular radially cross-sectional shape and a radially outer surface that is threaded, the sliding rail member 38 is securely connected to the lower end of the bat's barrel section 12 by threadably inserting the barrel-mating post 40 into the longitudinal cavity that is formed on this lower end, the handle-mating post 54 of the slide mechanism's rail guide 32 also has a circular radially cross-sectional shape and a radially outer surface that is threaded, and the rail guide 32 is securely connected to the upper end of the bat's handle section 14 by threadably inserting the handle-mating post 54 into the longitudinal cavity that is formed on this upper end.

Referring again to FIGS. 4, 8 and 12, and as exemplified in FIG. 21, the upper portion of the non-sliding member 100 includes a barrel-mating post 102, the middle portion of the non-sliding member includes a central base 104, and the lower portion of the non-sliding member includes a handle-mating post 106. The bottom of the barrel-mating post 102 is rigidly disposed onto a central position on the top surface 108 of the central base 104, and the top of the handle-mating post 106 is rigidly disposed onto a central position on the bottom surface 110 of the central base 104, such that the barrel-mating post 102 and the central base 104 and the handle-mating post 106 have a substantially common longitudinal axis Y5 which is substantially orthogonal to the top and bottom surfaces 108 and 110. The barrel-mating post 102 has a circular radially cross-sectional shape, and a length L7 and a diameter D10 that are substantially equal to the length L3 and the diameter D5 of the sliding rail member's 38 barrel-mating post 40; the radially outer surface of the barrel-mating post 102 is also threaded with a thread arrangement that is substantially the same as that employed on the sliding rail member's 38 barrel-mating post 40. Similarly, the handle-mating post 106 has a circular radially cross-sectional shape, and a length L8 and a diameter D11 that are substantially equal to the length L4 and the diameter D6 of the rail guide's 32 handle-mating post 54; the radially outer surface of the handle-mating post 106 is also threaded with a thread arrangement that is substantially the same as that employed on the rail guide's 32 handle-mating post 54. In an exemplary implementation of the non-sliding member described in this section, the radially outer length L9 if the non-sliding member is substantially equal to the radially outer length L2 of the slide mechanism 30.

Given the foregoing and referring again to FIGS. 4, 8, 12 and 21, the non-sliding member 100 can be used to replace the slide mechanism 30 that is interposed into the bat in the following manner. First, the slide mechanism's sliding rail member 38 can be disconnected from the lower end of the bat's barrel section 12 by threadably removing the barrel-mating post 40 from the longitudinal cavity that is formed on this lower end. Then, the barrel-mating post 102 of the non-sliding member 100 can be threadably inserted into the longitudinal cavity on the lower end of the bat's barrel section 12. Then, the slide mechanism's rail guide 32 can be disconnected from the upper end of the bat's handle section 14 by threadably removing the handle-mating post 54 from the longitudinal cavity that is formed on this upper end. Then, the handle-mating post 106 of the non-sliding member 100 can be threadably inserted into the longitudinal cavity on the upper end of the bat's handle section 14. The just-described configuration of the non-sliding member 100 insures that the longitudinal axis Y1 of the lower end of the barrel section 12 is substantially orthogonal to the top surface 108 of the non-sliding member's central base 104, and the bottom surface of the barrel section is substantially flush with this top surface 108, when this lower end is connected to the non-sliding member. The configuration of the non-sliding member 100 also insures that the longitudinal axis Y2 of the upper end of the handle section 14 is substantially orthogonal to the bottom surface 110 of the central base 104, and the top surface of the handle section is substantially flush with this bottom surface 110, when this upper end is connected to the non-sliding member.

3.0 Tennis Racket Application

Figures 22, 23:
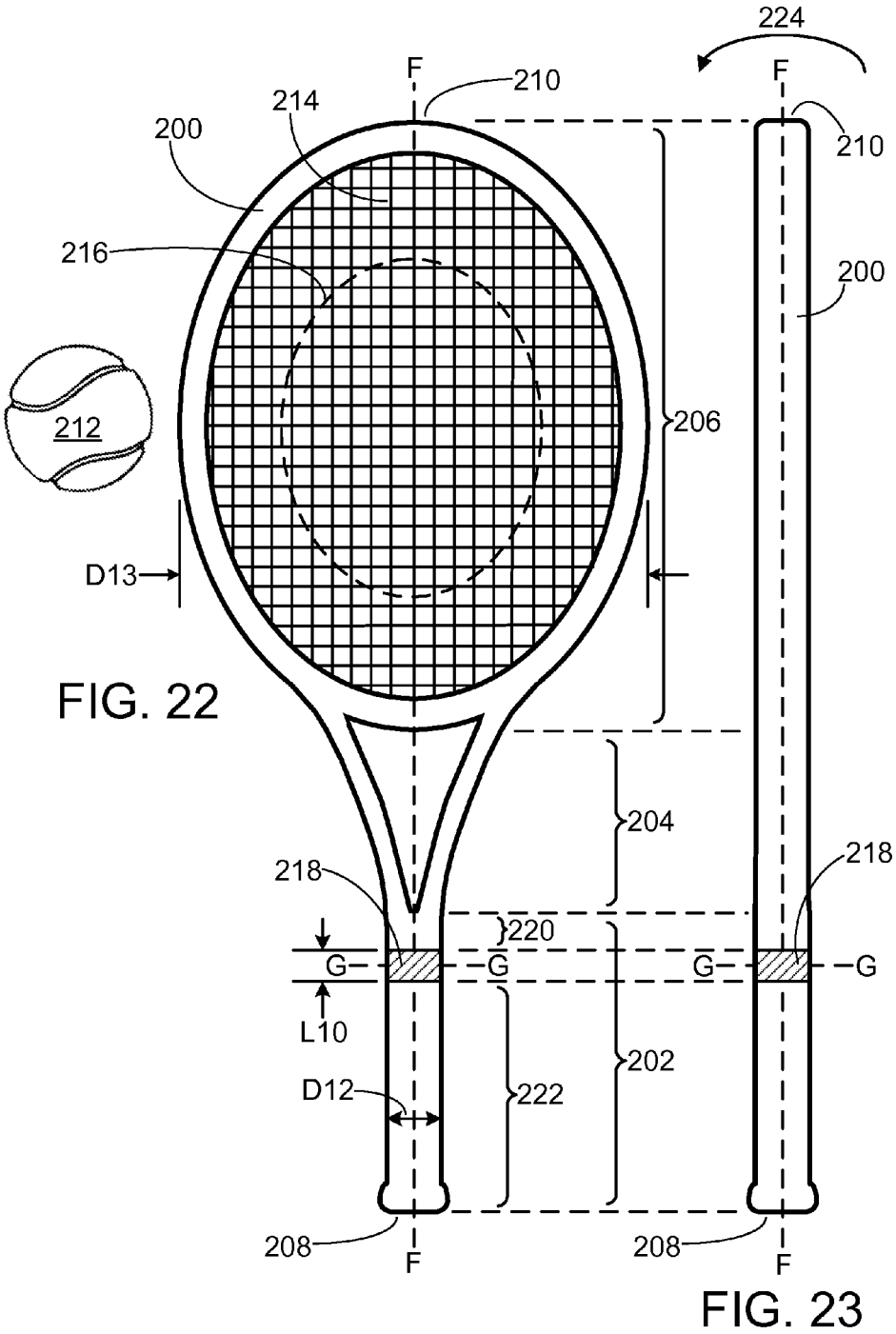
FIG. 22 is a diagram illustrating a plan view, in simplified form, of an exemplary embodiment of a conventional tennis racket and a conventional tennis ball.
FIG. 23 is a diagram illustrating a plan view, in simplified form, of the tennis racket of FIG. 22 rotated left 90 degrees.

FIG. 22 illustrates a plan view, in simplified form, of an exemplary embodiment of a conventional tennis racket (herein sometimes simply referred to as a racket, and also known as a tennis racquet) that is swung by a tennis player in an attempt to hit a conventional tennis ball. FIG. 23 illustrates a plan view, in simplified form, of the tennis racket of FIG. 22 rotated left 90 degrees. As exemplified in FIGS. 22 and 23, the tennis racket 200 generally includes three different longitudinal sections that are arranged along the longitudinal axis F-F of the racket, namely a handle section 202 the lower end of which forms the proximal end 208 of the racket, a head section 206 the upper end of which forms the distal end 210 of the racket, and a throat section 204 that rigidly interconnects the handle and head sections 202 and 206. The handle section 202 of the racket 200 includes an upper portion 220 and a lower portion 222. A substantial majority of the handle section 202 of the racket 200 has a longitudinally constant diameter D12 that is selected to allow the player to comfortably grip the racket with one of their hands (e.g., a right-handed player will usually grip the racket with their right hand, and a left-handed player will usually grip the racket with their left hand). The head section 206 of the racket 200 is meant to hit the tennis ball 212 and thus has a range of diameters that is greater than the diameter D12 and less than or equal to a prescribed maximum diameter D13 that is substantially larger than D12. The head section 206 includes an oval-shaped hoop the interior of which is "stringed" with a planar network of cord 214 (e.g., the cord is stretched tightly both horizontally and vertically across the interior of the hoop). The central portion 216 of this oval-shaped hoop is often referred to as the "sweet spot" of the racket's head section 206 since it will transfer the largest amount of force to the tennis ball 212 and it is generally more "forgiving" when the ball is hit in an off-center manner.

As is appreciated in the sport of tennis and referring again to FIG. 22, the tennis racket 200 can be made from various types of materials such as a prescribed type of wood (e.g., maple, or ash, or bamboo, among other types of woods), or a prescribed type of light-weight metal (e.g., aluminum, or titanium, among other types of metals), or a prescribed composite material (e.g., a mixture of one or more of graphite, carbon fiber, fiberglass, and Kevlar bonded together using a prescribed resin). As will be appreciated from the more detailed description that follows, the training apparatus embodiments described herein can be used with any type of tennis racket.

The training apparatus embodiments described in this section generally relate to the field of tennis rackets and more particularly to a tennis racket swing training apparatus that tennis players can use to improve the mechanics of how they swing their racket (e.g., perfect their swing) and thus become better tennis players. The training apparatus embodiments described in this section generally include a conventional tennis racket and the previously described slide mechanism which is interposed into the racket in a manner that converts the racket into a racket swing training apparatus. More particularly and referring again to FIGS. 22 and 23, in an exemplary embodiment of the training apparatus described in this section the conventional tennis racket 200 is cut through transversely along its longitudinal axis F-F (e.g., the racket 200 is cut through in a direction that is substantially orthogonal to the axis F-F) a prescribed short distance beneath the upper end of the handle section 202 (e.g., the racket is cut along the line G-G), and a small longitudinal section 218 of the racket is removed. In an exemplary implementation of this embodiment the longitudinal section 218 of the racket 200 that is removed has a length L10 that is substantially equal to the radially outer length L2 of the slide mechanism. This cutting of the racket 200 thus separates the upper portion 220 of the handle section 202 from the lower portion 222 of the handle section and forms a gap there-between. After the longitudinal section 218 of the racket 200 has been removed, the slide mechanism is inserted within the just-described gap in a manner that enables the upper portion 220 of the handle section 202 (and thus the throat and head sections 204 and 206 that extend from this upper portion 220) to move transversely the aforementioned prescribed maximum rail travel distance D4 relative to the lower portion 222 of the handle section when a tennis player swings 224 the racket in a desired manner, where this transverse movement is confined to a direction that is substantially orthogonal to the head section's 206 planar network of cord 214. The fact that the length L10 of the longitudinal section 218 of the racket 200 that is removed is substantially equal to the radially outer length L2 of the slide mechanism is advantageous since it results in the length of the racket after the slide mechanism has been interposed there-within being substantially the same as the original length of the racket before it is cut.

Figure 24:
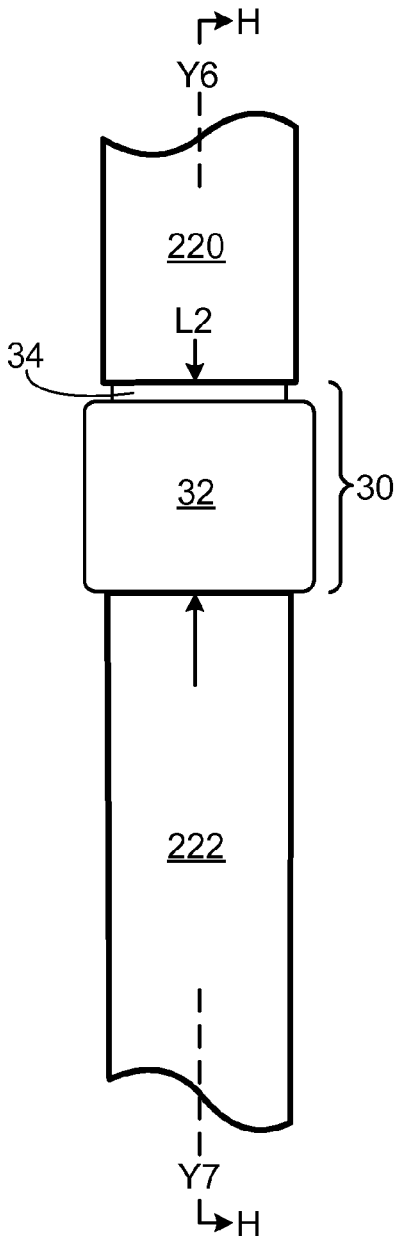
FIG. 24 is a diagram illustrating a plan view, in simplified form, of an exemplary embodiment of the slide mechanism shown connected in-between the lower end of an upper portion of a handle section of the tennis racket and the upper end of a lower portion of this handle section, where the sliding rail assembly of the slide mechanism is securely connected to this lower end such that the sliding rail assembly and the upper portion of the handle section are substantially coaxial, the rail guide of the slide mechanism is securely connected to this upper end such that the rail guide and the lower portion of the handle section are substantially coaxial, and the sliding rail assembly is situated in a rightmost position on the rail guide such that the upper and lower portions of the handle section are substantially coaxial.

FIG. 24 illustrates a plan view, in simplified form, of an exemplary embodiment of the slide mechanism 30 shown connected in-between the lower end of the upper portion 220 of the handle section of the tennis racket and the upper end of the lower portion 222 of this handle section. As exemplified in FIG. 24, the sliding rail assembly 34 of the slide mechanism 30 is securely connected to the lower end of the upper portion 220 of the racket's handle section in a manner that insures the sliding rail assembly and this upper portion 220 are substantially coaxial regardless of how the racket is swung. The rail guide 32 of the slide mechanism 30 is securely connected to the upper end of the lower portion 222 of the racket's handle section in a manner that insures the rail guide and this lower portion 222 are substantially coaxial regardless of how the racket is swung. The sliding rail assembly 34 shown in FIG. 24 is situated in a rightmost position on the rail guide 32 such that the longitudinal axis Y6 of the upper portion 220 of the racket's handle section is substantially aligned with the longitudinal axis Y7 of the lower portion 222 of the racket's handle section (e.g., these upper and lower portions 220 and 222 are substantially coaxial when the sliding rail assembly 34 is situated in the rightmost position). As will be appreciated from the foregoing description of the slide mechanism 30, the momentum of the tennis player's backswing will cause the sliding rail assembly 34 and the upper portion 220 of the racket's handle section to move to the rightmost position.

Figure 25:
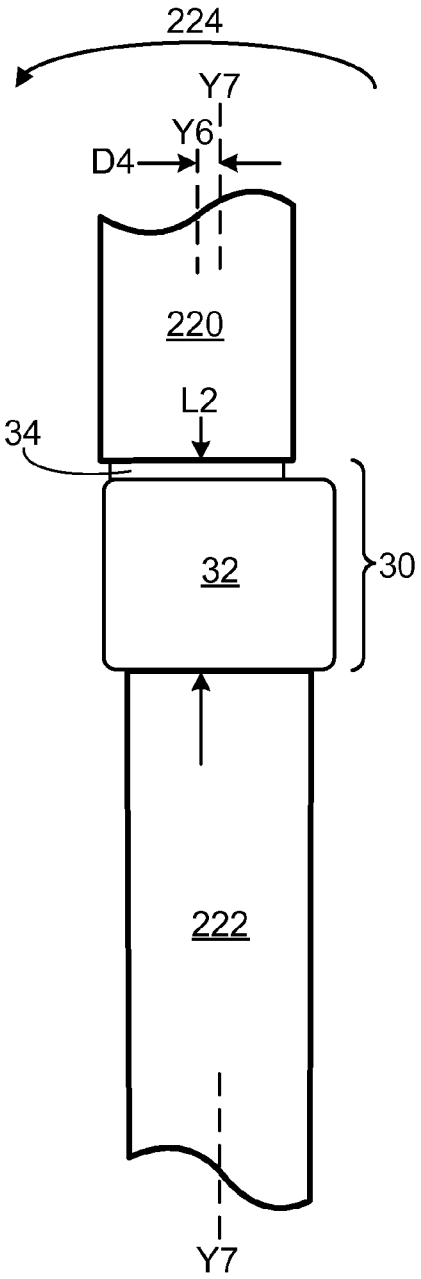
FIG. 25 is a diagram illustrating a plan view, in simplified form, of the slide mechanism of FIG. 24 where the sliding rail assembly is situated in a leftmost position on the rail guide such that the upper portion of the handle section of the tennis racket is transversely offset a prescribed distance from the lower portion of the handle section.

FIG. 25 illustrates a plan view, in simplified form, of the slide mechanism 30 of FIG. 24 where the sliding rail assembly 34 is situated in a leftmost position on the rail guide 32 such that the longitudinal axis Y6 of the upper portion 220 of the tennis racket's handle section is transversely offset the maximum rail travel distance D4 from the longitudinal axis Y7 of the lower portion 222 of the racket's handle section. As will be appreciated from the foregoing description of the slide mechanism 30, this transverse offset between the upper portion 220 of the racket's handle section and the lower portion 222 thereof can be caused by forces incurred during a desired swing 224 of the racket. Referring again to FIG. 23, FIG. 26 illustrates an enlarged front-facing cross-sectional view, in simplified form, of the slide mechanism 30 shown in FIG. 24 taken along the longitudinal axis F-F of the racket 200. FIG. 27 illustrates an enlarged front-facing cross-sectional view, in simplified form, of the slide mechanism 30 shown in FIG. 25 taken along the longitudinal axis F-F of the racket 200. FIG. 28 illustrates an enlarged cross-sectional view, in simplified form, of the slide mechanism 30 shown in FIG. 24 taken along line H-H of FIG. 24. As exemplified in FIGS. 24-27, after the slide mechanism 30 has been completely assembled and connected to the upper and lower portions 220 and 222 of the tennis racket's handle section, the slide mechanism 30 permits limited, low-friction, transverse movement of the upper portion 220 relative to the lower portion 222 with substantial mechanical integrity. In other words, the slide mechanism 30 permits low-friction lateral movement of the upper portion 220 relative to the lower portion 222 during a swinging 224 of the racket, where this lateral movement/motion/shift is confined to a direction that is substantially orthogonal to both the longitudinal axis Y6 of the upper portion 220 and the longitudinal axis Y7 of the lower portion 222, where this transverse movement is confined to a direction that is substantially orthogonal to the head section's 206 planar network of cord 214 and this lateral movement/motion/shift is limited to the distance D4. The particular value for the distance D4 is selected based on the stiffness of the racket 200, among other factors.

Figure 26:
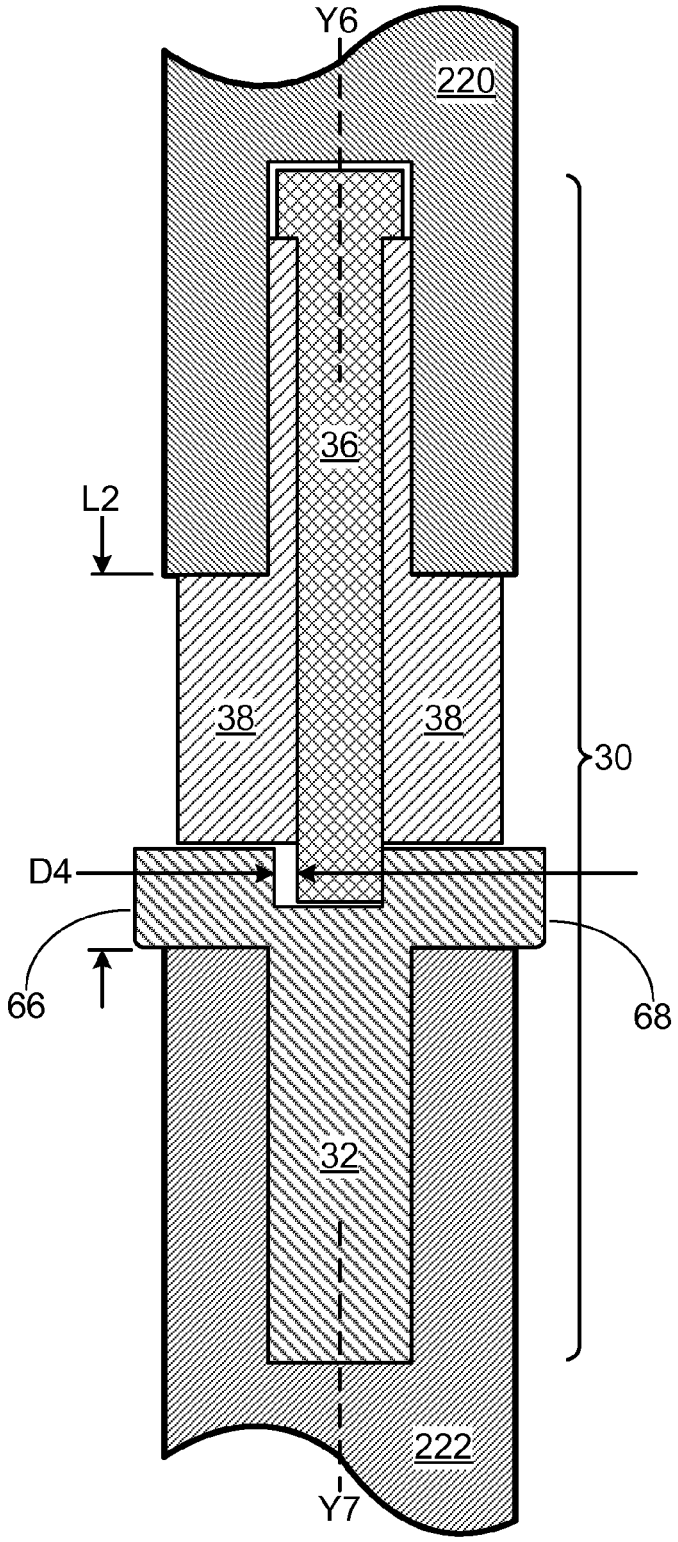
FIG. 26 is a diagram illustrating an enlarged front-facing cross-sectional view, in simplified form, of the slide mechanism shown in FIG. 24 taken along the longitudinal axis of the tennis racket.
Figure 27:
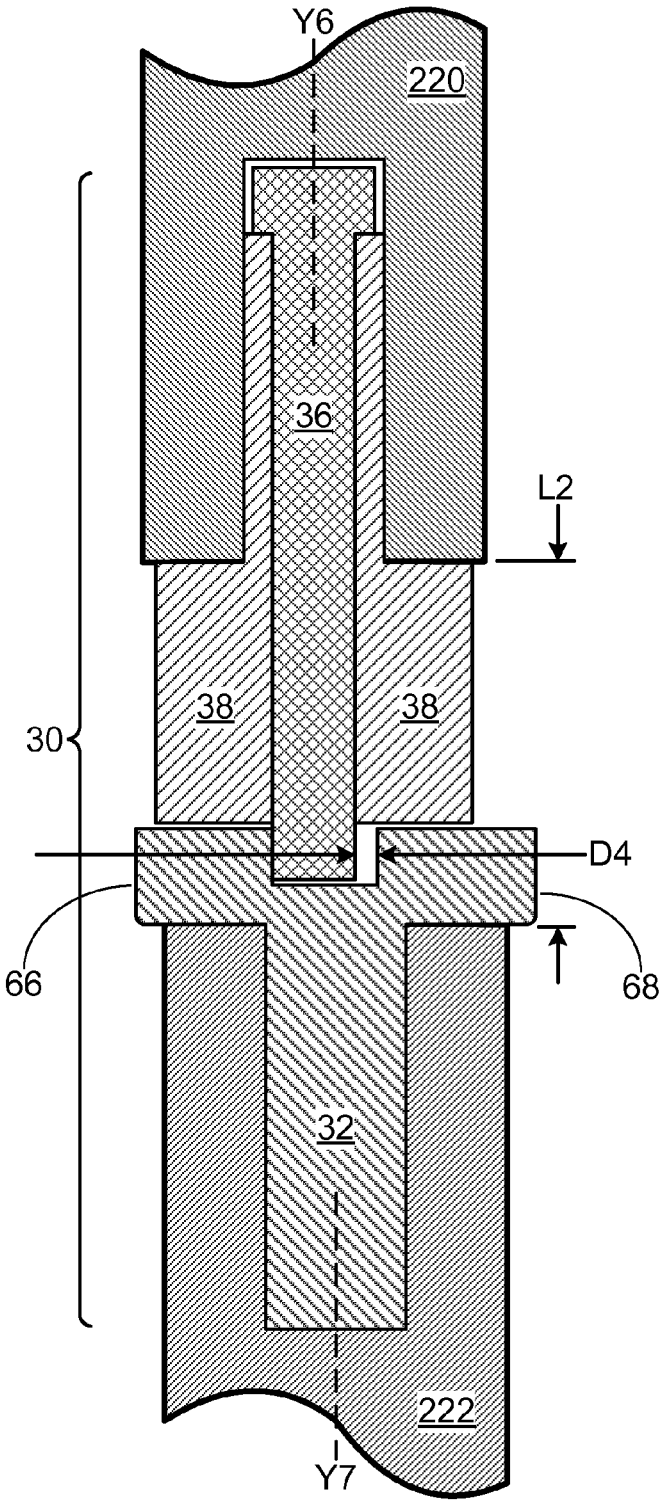
FIG. 27 is a diagram illustrating an enlarged front-facing cross-sectional view, in simplified form, of the slide mechanism shown in FIG. 25 taken along the longitudinal axis of the tennis racket.
Figure 28:
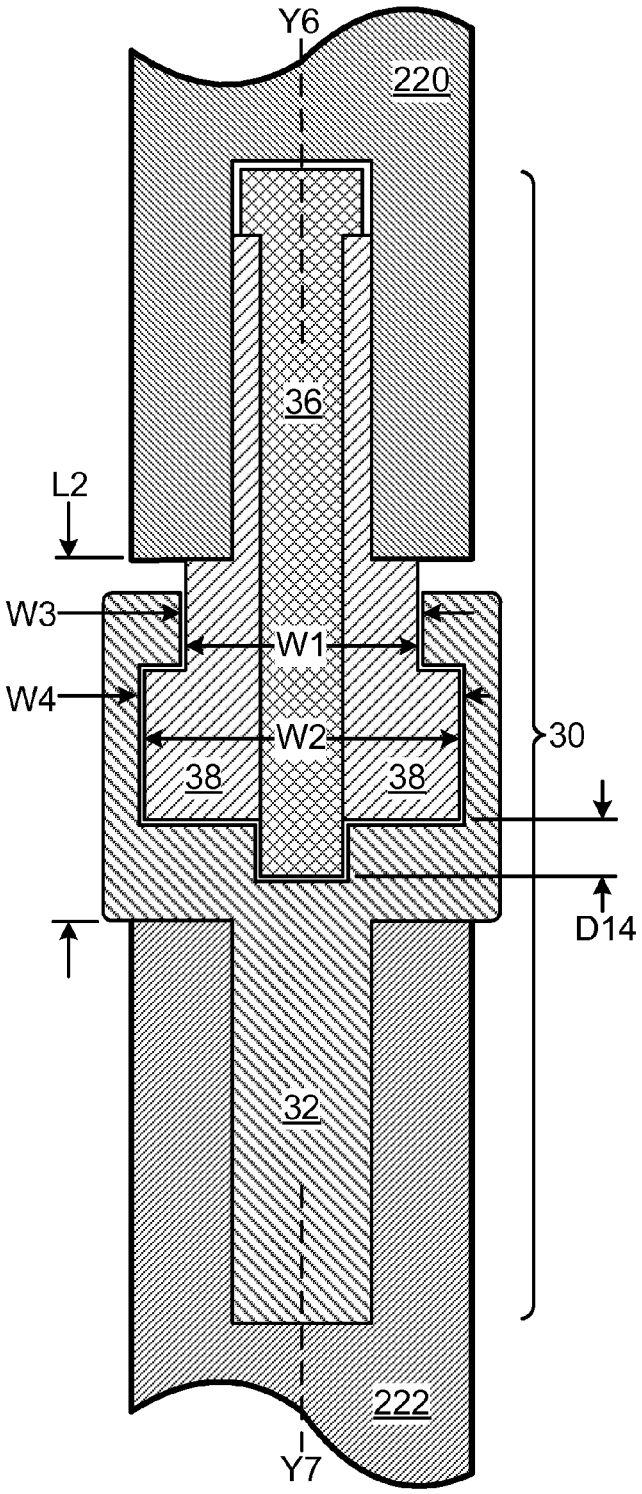
FIG. 28 is a diagram illustrating an enlarged cross-sectional view, in simplified form, of the slide mechanism shown in FIG. 24 taken along line H-H of FIG. 24.

As exemplified in FIGS. 26-28, the upper portion of the sliding rail assembly's 34 sliding rail member 38 is adapted to permit the lower end of the upper portion 220 of the tennis racket's handle section to be securely connected to the upper portion of the sliding rail assembly's 34 sliding rail member 38 in a manner that insures the upper portion 220 is substantially coaxial with the sliding rail assembly 34 regardless of how the racket is swung. The lower portion of the rail guide 32 is adapted to permit the upper end of the lower portion 222 of the racket's handle section to be securely connected to the rail guide 32 in a manner that insures the lower portion 222 is substantially coaxial with the rail guide 32 regardless of how the racket is swung. It is noted that this secure connection can be realized in a variety of ways including, but not limited to, the different ways described heretofore in relation to the baseball bat swing training apparatus.

Referring again to FIGS. 23-27, the training apparatus embodiments described in this section are advantageous since the slide mechanism 30 permits the tennis player to hear and feel the transverse movement of the upper portion 220 of the tennis racket's handle section relative to the lower portion 222 thereof when the tennis player swings 224 the racket 200 in a desired manner. In other words, when the side mechanism 30 is interposed into the racket 200 as described heretofore, the mechanism provides the player with both audible and tactile feedback indicating whether or not they have achieved a desired swing 224 profile.

Figure 29:
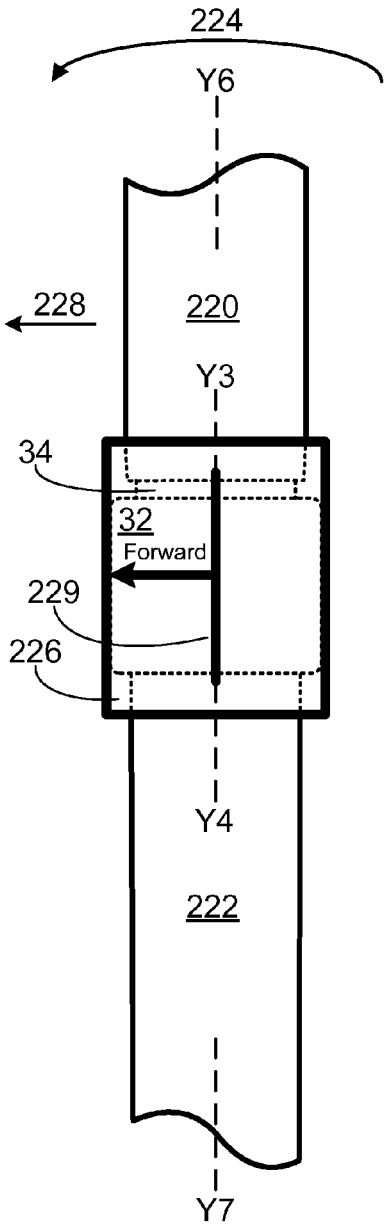
FIG. 29 is a diagram illustrating a transparent plan view, in simplified form, of another embodiment of the protective sleeve that can be disposed around the slide mechanism after it has been connected in-between the upper and lower portions of the tennis racket's handle section.
Figure 30:
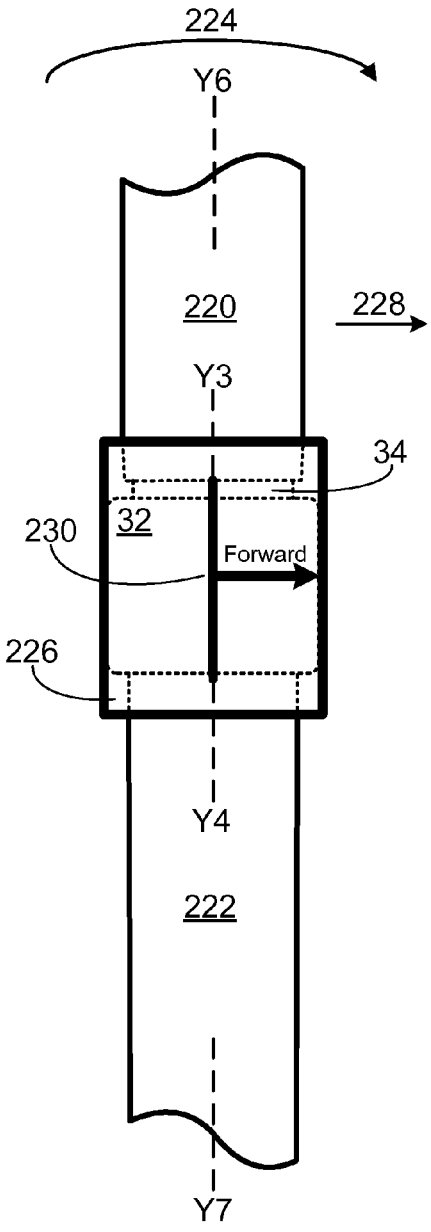
FIG. 30 is a diagram illustrating a transparent plan view, in simplified form, of the protective sleeve and slide mechanism of FIG. 29 rotated right 180 degrees.

FIG. 29 illustrates a transparent plan view, in simplified form, of another embodiment of the protective sleeve that can optionally be disposed around the slide mechanism after it has been connected in-between the upper and lower portions of the tennis racket's handle section. FIG. 30 illustrates a transparent plan view, in simplified form, of the protective sleeve and slide mechanism of FIG. 29 rotated right 180 degrees. As exemplified in FIGS. 29 and 30, the protective sleeve 226 is disposed around the sliding rail assembly 34 and the rail guide 32 of the slide mechanism in a manner that covers the slide mechanism, overlaps the radially lower exterior surface of the upper portion 220 of the tennis racket's handle section, and also overlaps the radially upper exterior surface of the lower portion 222 of the racket's handle section. Since the protective sleeve is durable and resiliently flexible, it permits the transverse movement 228 of the upper portion 220 relative to the lower portion 222 when the tennis player swings 224 the racket in a desired manner.

Referring again to FIGS. 29 and 30, the protective sleeve 226 can include a visible line 229 that is imprinted on the radially exterior surface of the sleeve, where this line 229 is substantially parallel to both the longitudinal axis Y3 of the sliding rail member and the longitudinal axis Y4 of the rail guide 32, and is located in a radial position that lies on an imaginary plane that intersects the axis Y4. The protective sleeve 226 can also include another visible line 230 that is also imprinted on the radially exterior surface of the sleeve, where this line 230 is also substantially parallel to both the longitudinal axis Y3 of the sliding rail member and the longitudinal axis Y4 of the rail guide 32, and is located in a radial position that is diametrically opposite the visible line 229. The lines 229 and 230 serve the following purpose. If either of the lines 229 or 230 is not substantially straight, this indicates that something may be wrong with the slide mechanism and it may have to be serviced (e.g., the connection between the sliding rail assembly 34 and the upper portion 220 of the tennis racket's handle section may have loosened, or the connection between the rail guide 32 and the lower portion 222 of the racket's handle section may have loosened).

Referring again to FIGS. 29 and 30, the tennis player, regardless of being right-handed or left-handed, will hold the tennis racket forward as indicated on the protective sleeve 226 for both their forehand and backhand swings. In other words, the player will rotate the racket 180 degrees when switching to a backhand swing after a forehand swing, or switching to a forehand swing after a backhand swing.

Referring again to FIGS. 22 and 23, it will be appreciated that the inherent weight of the slide mechanism, and also the inherent weight of the protective sleeve to a smaller degree, can change the balance point of the tennis racket 200 which may be disadvantageous, where the degree of this change depends on the actual weight of the mechanism and sleeve, and the particular location along the racket's longitudinal axis F-F where the mechanism is interposed. In order to counterbalance the weight of the slide mechanism after it has been interposed into the racket 200 and also counter-balance the weight of the protective sleeve, a counterweight member (not shown) can optionally be securely attached to the proximal end 208 of the racket. It is noted that various embodiments of the counterweight member are possible, examples of which will now be provided. In one embodiment of the training apparatus described in this section the counterweight member can be securely disposed onto the proximal end 208 of the racket 200. In another embodiment of the training apparatus the counterweight member can include a threaded shaft which is threadably inserted into a mating aperture that is formed on the proximal end 208 of the racket 200. Usage of the counterweight member is advantageous since it serves to recreate the original balance point of the racket 200 after the slide mechanism has been interposed into the racket. The counterweight member can have various different weights, where the particular weight that is chosen depends on various factors such as the type of racket 200 the slide mechanism is being interposed into, the weight of the racket, the particular location on the racket where the slide mechanism is interposed, the weight of the slide mechanism, and the weight of the protective sleeve, among other factors.

It is noted that the aforementioned non-sliding member can also be used to replace a slide mechanism that is interposed into a tennis racket as described heretofore and maintain the upper portion of the racket's handle section in substantial coaxial alignment with the lower portion of the racket's handle section at all times regardless of how the racket is swung, thus converting the racket back into its original form and functionality.

4.0 Other Embodiments

While the training apparatus has been described by specific reference to embodiments thereof, it is understood that variations and modifications thereof can be made without departing from the true spirit and scope of the training apparatus. By way of example but not limitation, rather than the slide mechanism and related protective sleeve embodiments and implementations described herein being interposed/installed into either an existing conventional baseball bat or an existing conventional tennis racket as described heretofore, alternate embodiments of the training apparatus are also possible where the slide mechanism and protective sleeve embodiments and implementations are directly manufactured into either a new training baseball bat or a new training tennis racket. The slide mechanism and protective sleeve embodiments and implementations can also be interposed/installed into any other type of conventional sports-related implement that is swung. For example, the slide mechanism and protective sleeve embodiments and implementations can be interposed/installed into a golf club, or a hockey stick, or the like. The slide mechanism and protective sleeve embodiments and implementations can also be interposed/installed into other types of bats such as a cricket bat, among other types of bats. The slide mechanism and protective sleeve embodiments and implementations can also be interposed/installed into other types of rackets such as a racquetball racket, or a paddle ball racket, or a badminton racket, among other types of rackets.

It is noted that any or all of the aforementioned embodiments throughout the description may be used in any combination desired to form additional hybrid embodiments. In addition, although the training apparatus embodiments have been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example embodiments. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims. In regard to the various functions performed by the above described components and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter.

Wherefore, what is claimed is:

1. A baseball bat swing training apparatus, comprising:

a baseball bat comprising two separate and distinct sections spaced apart to form a gap there-between, said sections comprising a handle section and a barrel section; and a slide mechanism inserted within said gap and connected to an upper end of the handle section and a lower end of the barrel section, the slide mechanism comprising a sliding rail assembly and a rail guide that are cooperatively configured to, insure said upper end and said lower end are substantially coaxial when the sliding rail assembly is situated in a rightmost position on the rail guide, and permit a lateral shift of said lower end relative to said upper end during a swinging of the bat.

2. The apparatus of claim 1, wherein, the sliding rail assembly comprises a sliding rail member, and an upper portion of the sliding rail member is adapted to permit the lower end of the barrel section to be connected to said upper portion in a manner that insures said lower end is substantially coaxial with the sliding rail assembly regardless of how the bat is swung.

3. The apparatus of claim 2, wherein, the lower end of the barrel section comprises a longitudinal cavity having a longitudinal axis substantially aligned with a longitudinal axis of said lower end, and the upper portion of the sliding rail member comprises a barrel-mating post, a radially cross-sectional shape of said post being substantially the same as a radially cross-sectional shape of said cavity, a length and diameter of said post being selected to permit said post to be snugly inserted into said cavity.

4. The apparatus of claim 3, wherein, the bat comprises a solid longitudinal interior, the radially cross-sectional shape of the longitudinal cavity is circular, a radially outer surface of the barrel-mating post is threaded, and the lower end of the barrel section is connected to the upper portion of the sliding rail member by threadably inserting said post into said cavity.

5. The apparatus of claim 4, wherein threads on the radially outer surface of the barrel-mating post are formed in a counterclockwise arrangement for a right-handed batter, and a clockwise arrangement for a left-handed batter.

6. The apparatus of claim 3, wherein, the radially outer surface of the barrel-mating post is substantially smooth, and the lower end of the barrel section is connected to the upper portion of the sliding rail member by inserting said post into the longitudinal cavity while an adhesive is used to adhere the radially outer surface of said post to a radial inner wall of said cavity.

7. The apparatus of claim 1, wherein a lower portion of the rail guide is adapted to permit the upper end of the handle section to be connected to said lower portion in a manner that insures said upper end is substantially coaxial with the rail guide regardless of how the bat is swung.

8. The apparatus of claim 7, wherein, the upper end of the handle section comprises a longitudinal cavity having a longitudinal axis substantially aligned with a longitudinal axis of said upper end, and the lower portion of the rail guide comprises a handle-mating post, a radially cross-sectional shape of said post being substantially the same as a radially cross-sectional shape of said cavity, a length and diameter of said post being selected to permit said post to be snugly inserted into said cavity.

9. The apparatus of claim 8, wherein the bat comprises a solid longitudinal interior, the radially cross-sectional shape of the longitudinal cavity is circular, a radially outer surface of the handle-mating post is threaded, and the upper end of the handle section is connected to the lower portion of the rail guide by threadably inserting said post into said cavity.

10. The apparatus of claim 9, wherein threads on the radially outer surface of the handle-mating post are formed in a counterclockwise arrangement for a right-handed batter, and a clockwise arrangement for a left-handed batter.

11. The apparatus of claim 8, wherein, the radially outer surface of the handle-mating post is substantially smooth, and the upper end of the handle section is connected to the lower portion of the rail guide by inserting said post into the longitudinal cavity while an adhesive is used to adhere the radially outer surface of said post to a radial inner wall of said cavity.

12. The apparatus of claim 1, wherein, the sliding rail assembly comprises a sliding rail member, a lower portion of sliding rail member comprises a tiered base, an upper portion of the rail guide comprises a guide block, an upper portion of guide block comprises a tiered linear guide channel that passes from a left side of the guide block to a right side thereof, and said guide channel is adapted to receive the tiered base in sliding engagement when the tiered base is slidably inserted into said guide channel, said sliding engagement permitting the sliding rail assembly to travel in a direction that is substantially orthogonal to both a longitudinal axis (Y3) of the sliding rail assembly and a longitudinal axis (Y4) of the rail guide.

13. The apparatus of claim 12, wherein, the tiered linear guide channel comprises an upper channel tier and a lower channel tier, a vertical axis of both the upper and lower channel tiers is substantially aligned with the longitudinal axis (Y4), the upper channel tier comprises a pair of opposing sidewalls, a prescribed width (W3), and a prescribed height (H3), the lower channel tier comprises another pair of opposing sidewalls, a prescribed width (W4) that is greater than the width (W3), and a prescribed height (H4), the tiered base comprises an upper base tier and a lower base tier, a vertical axis of both the upper and lower base tiers is substantially aligned with the longitudinal axis (Y3), the upper base tier comprises a prescribed width (W1) that is slightly less than the width (W3), and a prescribed height (H1) that is greater than the height (H3), and the lower base tier comprises a prescribed width (W2) that is slightly less than the width (W4), and a prescribed height (H2) that is slightly less than the height (H4).

14. The apparatus of claim 13, wherein, the difference between widths (W1) and (W3) is greater than or equal to 0.01 millimeters and less than or equal to 0.02 millimeters, the difference between widths (W2) and (W4) is also greater than or equal to 0.01 millimeters and less than or equal to 0.02 millimeters, and the difference between heights (H2) and (H4) is also greater than or equal to 0.01 millimeters and less than or equal to 0.02 millimeters.

15. The apparatus of claim 12, wherein the tiered base comprises rounded edges and rounded corners.

16. The apparatus of claim 12, wherein the guide block comprises rounded exterior edges and rounded exterior corners.

17. The apparatus of claim 12, wherein, the sliding rail member further comprises a longitudinal aperture that passes from a top of the sliding rail member to a bottom thereof, a longitudinal axis of said aperture is substantially aligned with the longitudinal axis (Y3), the tiered linear guide channel comprises a lower channel tier, the guide block further comprises a rail travel distance limiting cavity that is located on a bottom surface of the lower channel tier and is adapted to limit the lateral shift of the lower end of the barrel section relative to the upper end of the handle section to a maximum rail travel distance (D4), the sliding rail assembly further comprises a slide-limiting member comprising an aperture-mating post, said post comprises a radially cross-sectional shape that is substantially the same as the radially cross-sectional shape of said aperture, said post comprises a prescribed length (L6) and a prescribed diameter (D9) that are selected to permit said post to be securely inserted into said aperture so that said post protrudes a prescribed distance (D14) from a bottom surface of the tiered base, said cavity comprises a prescribed depth (D7), a prescribed width (W5), and a prescribed length (L5), the depth (D7) is greater than the distance (D14), and both the width (W5) and length (L5) are greater than the diameter (D9), thus permitting said post to travel laterally within said cavity, and said post insertion occurs after the tiered base has been slidably inserted into said guide channel so that a bottom of said post protrudes into said cavity, the difference between length (L5) and diameter (D9) defining the distance (D4).

18. The apparatus of claim 1, wherein the lateral shift of the lower end of the barrel section relative to the upper end of the handle section is limited to a distance of approximately 5.0 millimeters.

19. The apparatus of claim 1, wherein the slide mechanism generates a discernible sound upon the lateral shift of the lower end of the barrel section relative to the upper end of the handle section.

20. The apparatus of claim 1, wherein the slide mechanism generates a tactile sensation at a proximal end of the bat upon the lateral shift of the lower end of the barrel section relative to the upper end of the handle section.

21. The apparatus of claim 1, further comprising one or more of:

a distal sound-emanating aperture that is added to a distal end of the bat whenever the bat comprises a hollow longitudinal interior; or a proximal sound-emanating aperture that is added to a proximal end of the bat whenever the bat comprises a hollow longitudinal interior.

22. The apparatus of claim 1, further comprising a protective sleeve that is disposed around the sliding rail assembly and the rail guide after the slide mechanism has been connected to the upper end of the handle section and the lower end of the barrel section, the sleeve covering the slide mechanism and overlapping a bottommost portion of said lower end and a topmost portion of said upper end, the sleeve being resiliently flexible so as to permit the lateral shift of the lower end of the barrel section relative to the upper end of the handle section.

23. The apparatus of claim 22, wherein the sleeve comprises one or more of:

a right-handed visible line that is imprinted on a radially exterior surface of the sleeve, the right-handed visible line being substantially parallel to a longitudinal axis (Y4) of the rail guide, and being located approximately 135 degrees radially to a right of the direction of the lateral shift of the lower end of the barrel section relative to the upper end of the handle section; or a left-handed visible line that is also imprinted on the radially exterior surface of the sleeve, the left-handed visible line also being substantially parallel to said axis (Y4), and being located diametrically opposite the right-handed visible line.

24. The apparatus of claim 23, wherein, a first text string is imprinted on the radially exterior surface of the sleeve adjacent to the right-handed visible line, the first text string indicating that the right-handed visible line applies to right-handed batters, and a second text string is imprinted on the radially exterior surface of the sleeve adjacent to the left-handed visible line, the second text string indicating that the left-handed visible line applies to left-handed batters.

25. The apparatus of claim 1, further comprising one or more of:

a right-handed spirit level that is attached to a radially exterior surface of the barrel section near the lower end of the barrel section, the right-handed spirit level comprising a transparent tubular vial that is sealed at both ends and is incompletely filled with liquid so as to leave a bubble within the vial, and a pair of substantially parallel indicator lines that are imprinted on the vial and are spaced apart a distance that is slightly larger than a length of the bubble, the right-handed spirit level being located at a position that allows an imaginary line which is substantially parallel to a longitudinal axis of the rail guide, and is located approximately 135 degrees radially to a right of the direction of the lateral shift of the lower end of the barrel section relative to the upper end of the handle section, to pass midway between said pair of indicator lines; or a left-handed spirit level that is attached to the radially exterior surface of the barrel section near the lower end of the barrel section, and is located at a position that is diametrically opposite the right-handed spirit level.

26. The apparatus of claim 1, further comprising a counterweight member that is attached to a proximal end of the bat.

27. The apparatus of claim 1, further comprising a non-sliding member that is adapted to replace the slide mechanism and maintain the lower end of the barrel section in substantial coaxial alignment with the upper end of the handle section at all times regardless of how the bat is swung.

28. A tennis racket swing training apparatus, comprising:

a tennis racket comprising a handle section, a head section, and a throat section that rigidly interconnects the handle and head sections, the handle section comprising two separate and distinct portions spaced apart to form a gap there-between, said portions comprising an upper portion of the handle section and a lower portion of the handle section; and a slide mechanism inserted within said gap and connected to an upper end of the lower portion of the handle section and a lower end of the upper portion of the handle section, the slide mechanism comprising a sliding rail assembly and a rail guide that are cooperatively configured to, insure the upper end of the lower portion of the handle section and the lower end of the upper portion of the handle section are substantially coaxial when the sliding rail assembly is situated in a rightmost position on the rail guide, and permit a lateral shift of the lower end of the upper portion of the handle section relative to the upper end of the lower portion of the handle section during a swinging of the racket.

* * * * *